US005590630A

United States Patent [19]

Kurihara et al.

[11] Patent Number: 5,590,630

[45] Date of Patent: Jan. 7, 1997

[54] IDLING SPEED CONTROL SYSTEM AND THE METHOD THEREOF

[75] Inventors: Masaru Kurihara; Masanori Igarashi, both of Tokyo, Japan

[73] Assignee: Fuji Jukogyo Kabushiki Kaisha, Tokyo, Japan

[21] Appl. No.: 539,354

[22] Filed: Oct. 5, 1995

[30] Foreign Application Priority Data

Oct. 17, 1994 [JP] Japan ..... 6-251075

[51] Int. Cl.[6] ..... F02D 41/16; F02D 43/04

[52] U.S. Cl. ..... 123/339.17; 123/339.21

[58] Field of Search ..... 123/339.17, 339.21, 123/339.22, 339.23, 179.16, 179.18

[56] References Cited

U.S. PATENT DOCUMENTS

| | | | |
|---|---|---|---|
| 4,862,851 | 9/1989 | Washino et al. | 123/339.21 |
| 4,877,002 | 10/1989 | Shimomura et al. | 123/339.21 |
| 5,052,357 | 10/1991 | Fujimoto et al. | 123/339.21 |
| 5,083,541 | 1/1992 | Chen | 123/339.17 |
| 5,111,788 | 5/1992 | Washino | 123/339.21 |
| 5,121,725 | 6/1992 | Araki | 123/339.21 |
| 5,163,398 | 11/1992 | Buslepp et al. | 123/339.21 |
| 5,213,077 | 5/1993 | Nishizawa et al. | 123/339.21 |
| 5,216,610 | 6/1993 | Douta et al. | 123/339.21 |
| 5,235,947 | 8/1993 | Watanabe | 123/339.17 |
| 5,495,835 | 3/1996 | Ueda | 123/339.21 |

OTHER PUBLICATIONS

Journal of JSAE, pp. 89 to 91, Oct. 4, 1994, Kurihara et al Development of a new idle speed control strategy "Fuel leading type".

*Primary Examiner*—Willis R. Wolfe

*Attorney, Agent, or Firm*—Beveridge, DeGrandi, Weilacher & Young, L.L.P.

[57] ABSTRACT

There is provided a system for controlling an idling speed of an engine, comprising: engine speed detecting means for detecting an actual engine speed, integration amount calculating means for calculating an integration amount based on an error between the actual engine speed and a predetermined target idling speed, reference parameter calculating means for calculating a reference parameter based on the actual engine speed and the integration amount, target physical amount providing means for providing an appropriate target physical amount which takes a balance between the engine torque and the engine friction around the predetermined target idling speed, depending on the reference parameter, fuel injection amount calculating means for calculating a fuel injection amount in accordance with the target physical amount, the fuel injection amount being injected by the injector, and opening degree determining means for determining an opening degree of the idling speed control valve in accordance with the target physical amount, the idling speed control valve being opened by the determined opening degree.

13 Claims, 27 Drawing Sheets

IDLING SPEED CONTROL SYSTEM AND THE METHOD THEREOF

BACKGROUND OF THE INVENTION

The present invention relates to an idling speed control method and system for an engine in which a fuel injection amount and an intake air amount are simultaneously controlled to adjust an idling speed.

Conventionally, as a system for controlling the idling speed of the engine constant irrespective of disturbance of load, there has been widely employed a system as shown in FIG. 36. or as disclosed, for example, in Japanese laid-open patent application No. 60(1985)-212648.

In this conventional system, there is provided an idling speed control valve (ISCV) for regulating an idling air amount in response to a control signal from a control unit. Opening degree (opening area) of the ISCV is adjusted by adding various correction amounts according to the engine operating conditions and a feedback correction amount according to a deviation between the actual engine speed and the target idling speed to a basic characteristic value determined by an engine temperature, the feedback correction value being changed by the PI control.

In this case, an intake air amount depending upon the opening degree of the ISCV is measured by an air flow meter or an intake air pressure sensor. A fuel injection amount is determined on the basis of the measured amount of air, and an engine torque is generated according to the fuel injection amount so as to coincide the engine speed with the target idling speed.

In the conventional idling speed control, there is a problem of delay with which the change of the engine torque follows the change of the opening degree of the ISCV. That is, for example, after the opening degree of the ISCV has been increased, a delay first occurs until an increased amount of air flows into the cylinder of the engine, and then a delay occurs until such the increased amount of air is measured and a fuel amount adjusted to the increased amount of air is supplied into the cylinder. Accordingly, a considerably great delay occurs until both air and fuel are matched and the engine torque increases, which causes failing to fulfill the demand for the responsibility and the speed convergence property.

It is considered that such the delay of the engine torque increase is caused by the superposition of following four factors.

(1) Mechanical delay in response of the ISCV.

(2) Air flowing delay until an air amount induced into a cylinder becomes equal to an air amount passing through the ISCV (delay due to filling air into an intake air chamber).

(3) Delay in measuring an amount of air induced for succeeding calculation of a fuel injection amount (delay in response of a sensor for measuring an intake air amount).

(4) Fuel transport delay in transport of fuel into a cylinder due to adhesion of fuel to wall surfaces of an intake port.

If the high-speed responsive ISCV and the injector which brings less adhesion of fuel to wall surfaces are adopted, the mechanical delay (1) and the delay in transport adhered fuel (4) may be decreased. However, they cannot completely eliminate these delays (1) and (4), not to solve the air flowing delay (2) and the measurement delay (3).

SUMMARY OF THE INVENTION

The present invention has been achieved in view of the above-described circumstances. An object of the present invention is to provide an idling speed control method and system for an engine in which a fuel injection amount is changed simultaneous with the change of opening degree of the ISCV to improve the response of the idling speed control to the change in load applied to the engine.

A further object of the present invention is to provide an idling speed control method and system in which a target physical amount regarded to have a linear relationship with a torque of the engine is used as a parameter to change a fuel injection amount and an opening degree of the ISCV simultaneously, whereby the engine torque is increased and decreased with a good followability to improve the convergence property of the idling speed.

A further object of the present invention is to provide an idling speed control method and system in which the integration control, feedforward control and learning control are adapted to precisely maintain the optimum idling speed.

Another object of the present invention is to provide an idling speed control method and system which can improve controllability of the idling speed at the start of the engine.

According to the present invention, there is provided a system and/or method for controlling the idling speed of an engine, comprising engine speed detecting means for detecting an actual engine speed, integration amount calculating means for calculating an integration amount based on an error between the actual engine speed and a predetermined target idling speed, reference parameter calculating means for calculating a reference parameter based on the actual engine speed and the integration amount, target physical amount providing means for providing an appropriate target physical amount which takes a balance between the engine torque and the engine friction around the predetermined target idling speed, depending on the reference parameter, fuel injection amount calculating means for calculating a fuel injection amount in accordance with the target physical amount, the fuel injection amount being injected by the injector, and opening degree determining means for determining an opening degree of the idling speed control valve in accordance with the target physical amount, the idling speed control valve being opened by the determined opening degree.

DETAILED DESCRIPTION OF THE PREFERRED EMBODIMENT

The embodiments of the present invention will be described hereinafter with reference to the drawings.

FIGS. 1 to 34 relates to a first embodiment according to the present invention.

Figure 12:
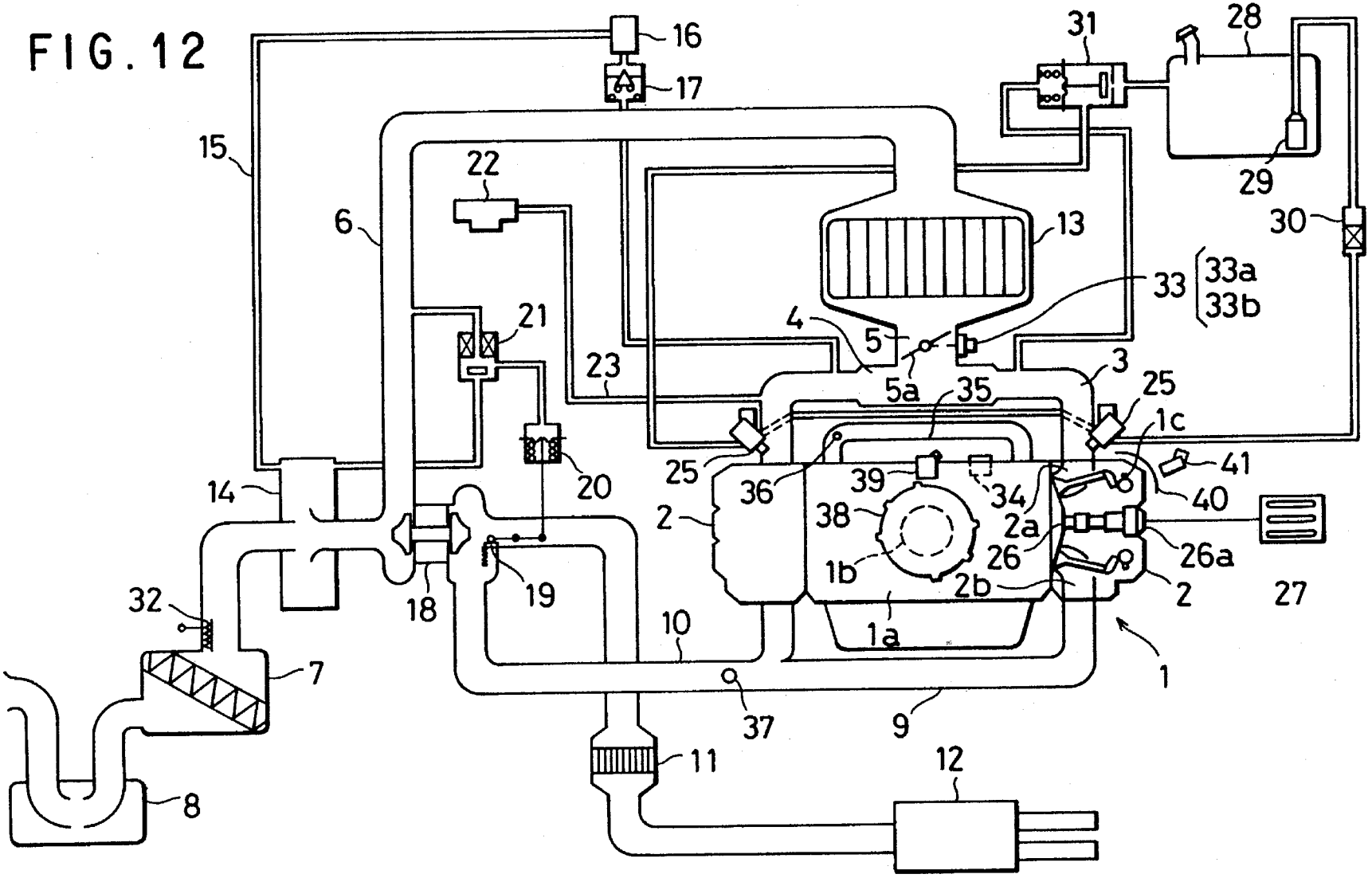
FIG. 12 is a schematic construction view of an engine system.

In FIG. 12, reference numeral 1 designates an engine body. In the engine body 1, an intake manifold 3 is communicated with an intake port 2*a* of a cylinder head 2, and a throttle passage 5 is communicated with the intake manifold 3 through an air chamber 4. An air cleaner 7 is communicated with the throttle passage 5 through an intake pipe 6, the air cleaner 7 being communicated with an air intake chamber 8 for taking intake air.

An exhaust pipe 10 is communicated with an exhaust port 2*b* through an exhaust manifold 9, and a catalyst converter 11 is mounted on the exhaust pipe 10 and is communicated with a muffler 12. Moreover, a throttle valve 5*a* is provided in the throttle passage 5, an inter-cooler 13 is mounted on the intake pipe 6 immediately upstream the throttle passage 5, and a resonator chamber 14 is mounted on the intake pipe 6 downstream the air cleaner 7.

Further, an idling speed control valve (ISCV) 16 for adjusting an amount of air during an idling state of the engine is mounted on a bypass passage 15 communicating the resonator chamber 14 with the intake manifold 3 to bypass the throttle valve 5*a*. The ISCV 16 is a high-speed type solenoid valve driven by an electronic control unit 50 (ECU, see FIG. 15) which will be described later. In the present embodiment, the ISCV 16 comprises a rotational slider for adjusting an area of the bypass passage 15 through which intake air passes and a rotary type solenoid for operating the rotational slider, and an opening area of the rotational slider (an opening degree of the ISCV) is controlled by the duty control.

Immediately downstream the ISCV 16 is mounted a check valve 17 which opens when an intake air pressure is negative and closes when the intake air pressure is positive by being supercharged by a turbocharger system.

The turbocharger system comprises a turbocharger 18 associated with the intake pipe 6, a waste gate valve 19, an actuator 20 for actuating the waste gate valve 19, and a duty solenoid valve 21 responsive to a control signal from the ECU for controlling the actuator 20. Accordingly, the duty solenoid valve 21 is controlled by the ECU 50 to actuate the actuator 20 so that an exhaust gas relief caused by the waste gate valve 19 is regulated to thereby control a supercharged pressure caused by the turbocharger 18.

An intake air pressure sensor (an absolute pressure sensor) 22 is communicated with the intake manifold 3 through a passage 23, and an injector 25 is provided immediately upstream each intake port 21 of each cylinder. An ignition plug 26 exposing its tip to a combustion chamber of each cylinder is mounted on the cylinder head 2 and connected through an ignition coil 26*a* to an igniter 27.

Fuel is fed under pressure from an in-tank type fuel pump 29 provided within a fuel tank 28 to the injector 25 via a fuel filter 30, and a fuel pressure to the injector 25 is regulated by a pressure regulator 31.

Further, a hot wire type or a hot film type intake air amount sensor 32 is mounted immediately downstream the air cleaner 7 of the intake pipe 6, and a throttle sensor 33 composed of a throttle opening degree sensor 33*a* and an idling switch 33*b* is connected to the throttle valve 5*a*.

Furthermore, a knocking sensor 34 is mounted on a cylinder block 1*a* of the engine body 1, a coolant temperature sensor 36 is provided on a coolant passage 35 communicating both left and right banks of the cylinder block 1*a*, and an O2 sensor 37 is provided on a gathering portion of the exhaust manifold 9.

A crank rotor 38 is mounted on a crank shaft 1*b* supported on the cylinder block 1*a*, and a crank angle sensor 39 composed of an electromagnetic pickup or the like is provided opposed to an outer periphery of the crank rotor 38.

Figure 13:
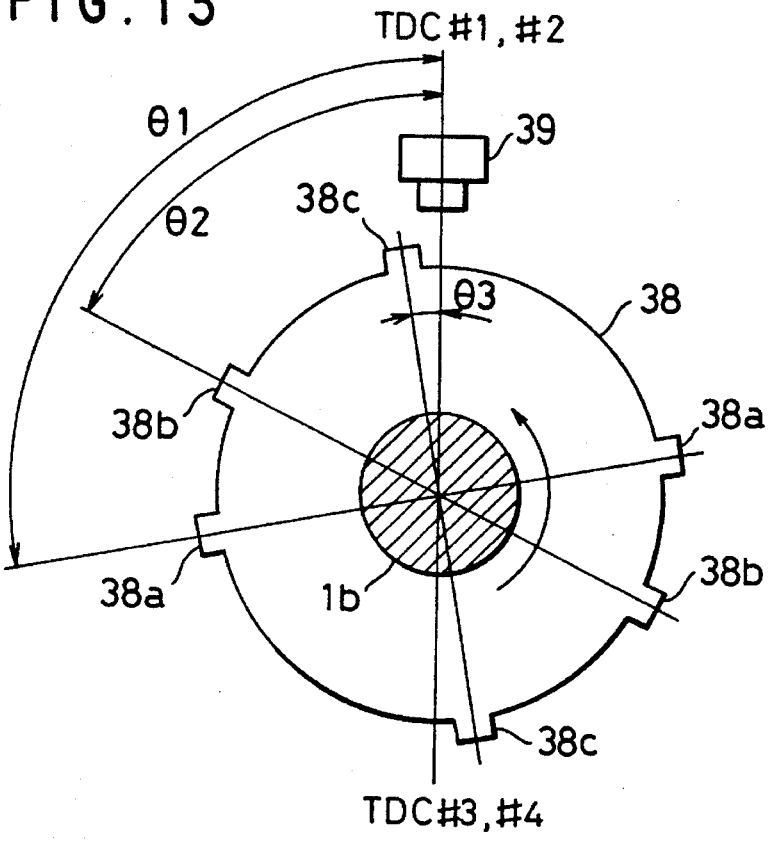
FIG. 13 is a front view of a crank rotor and a crank angle sensor.

As shown in FIG. 13, the crank rotor 38 is formed on its outer periphery with protrusions 38*a*, 38*b* and 38*c*, which are in turn formed at positions θ1, θ2 and θ3 before compression top dead center (BTDC) of each cylinder (#1, #2 and #3, #4). In the present embodiment, θ1=97° CA, θ2=65° CA and θ3=10° CA.

The protrusions of the crank rotor 38 are detected by the crank angle sensor 39, and crank pulses of BTDC 97°, 65° and 30° are output to the ECU 50 every ½ rotation of the engine. Time interval of the input signals are timed by the ECU 50 to calculate the engine speed.

Figure 14:
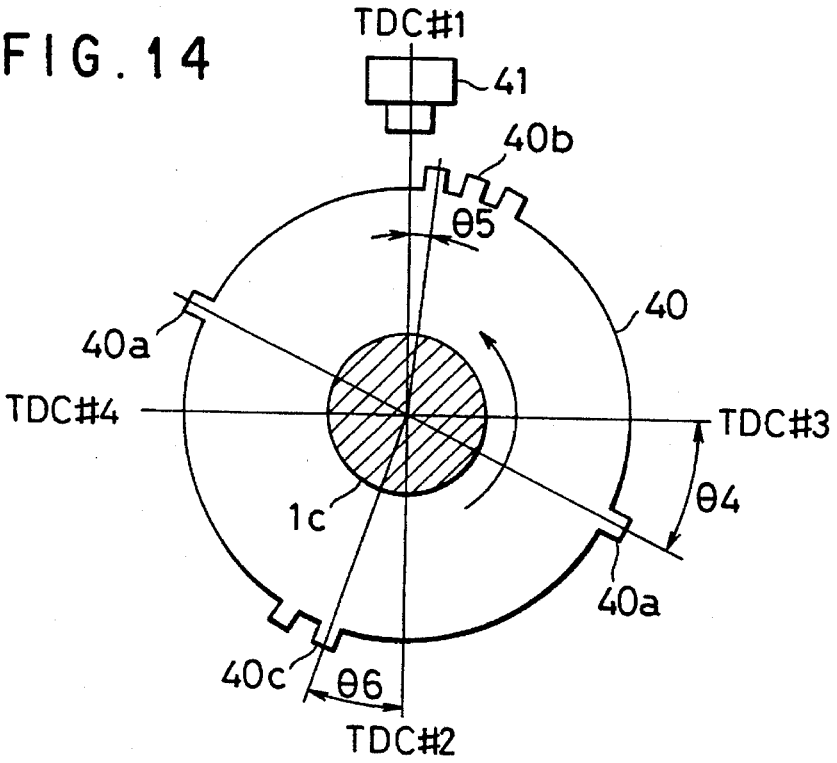
FIG. 14 is a front view of a cam rotor and a cam angle sensor.

Further, as shown in FIG. 14, a cylinder discriminating cam angle sensor 41 composed of an electromagnetic pickup or the like is provided opposed to protrusions 40*a*, 40*b* and 40*c* formed on an outer periphery of a cam rotor 40 connected to the cam shaft 1*c* of the engine body 1. Output cam pulses from the cylinder discriminating cam angle sensor 41 is fed to the ECU 50 which counts the cam pulses and determines a particular cylinder being presently in the combustion stroke.

It is to be noted that the crank angle sensor 39 and the cam angle sensor 41 are not limited to a magnetic sensor such as an electromagnetic pickup but may be a photo sensor.

Figure 15:
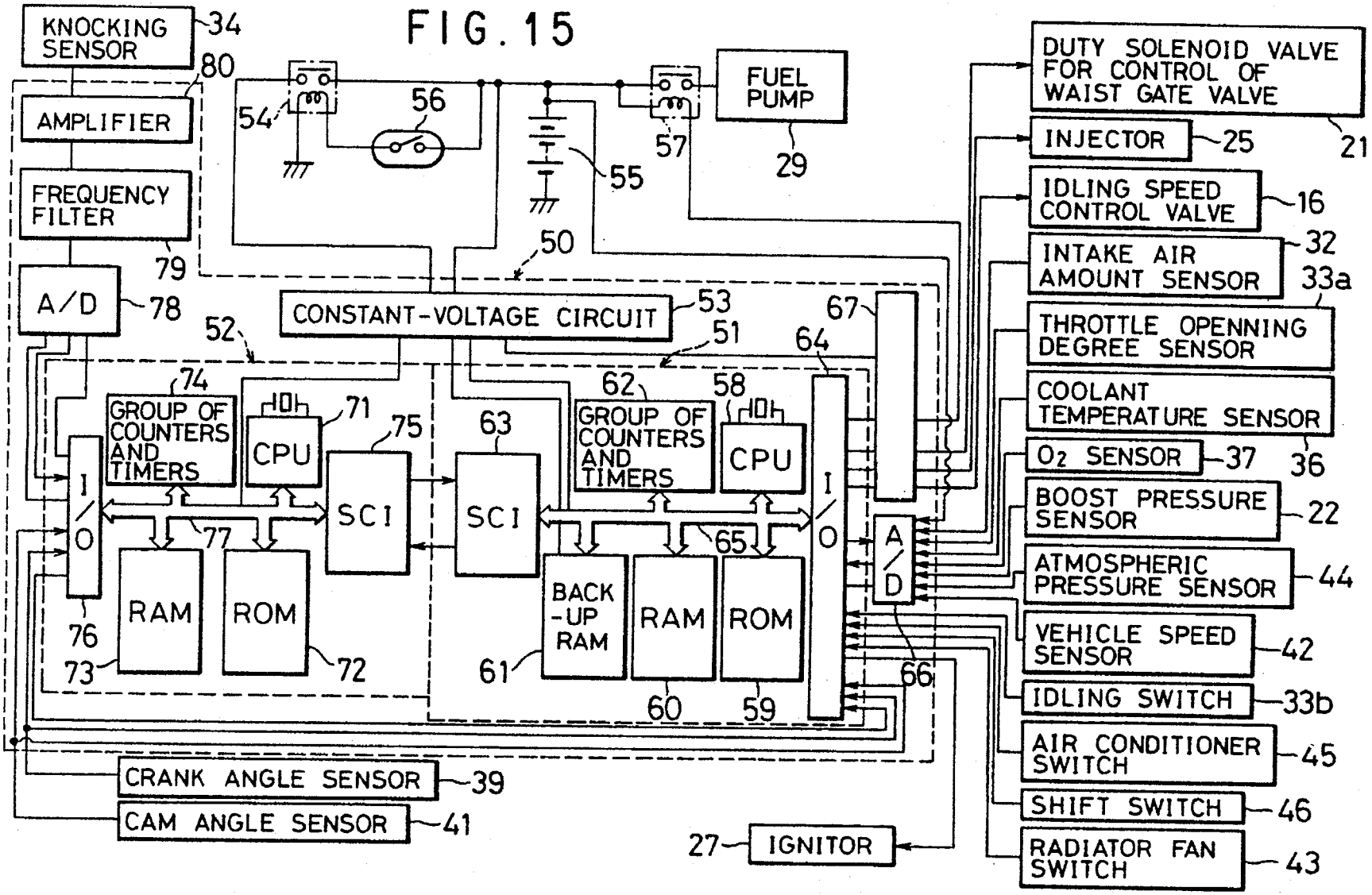
FIG. 15 is a circuitry view of an electronic control system.

Moreover, FIG. 15 shows the structure of the ECU for controlling the engine. In this embodiment, the ECU 50 is composed of two computers, one being a main computer 51 for performing a fuel injection control and an ignition timing control, the other being a sub-computer 52 exclusive use for performing a knocking detection processing. A constant-voltage circuit 53 for supplying a predetermined stabilized power supply to various parts and various peripheral circuits are incorporated in the ECU 50.

The constant-voltage circuit 53 is connected to a battery 55 through a relay contact of an ECU relay 54. A relay coil of the ECU relay 54 is connected to the battery 55 through an ignition switch 56. When the ignition switch 56 is turned ON to close the relay contact of the ECU relay 54, power supply is supplied through the constant-voltage circuit 53 to the main computer 51 and the sub-computer 52. The constant-voltage circuit 53 is also directly connected to the battery 55, and power supply for back-up is continuously supplied to a back-up RAM 61 in the main computer 51 through the constant-voltage circuit 53 to hold data therein irrespective of the status of the ignition switch 56. A fuel pump 29 is connected to the battery 55 through a relay contact of a fuel pump relay 57.

The main computer 51 is a micro-computer having CPU 58, ROM 59, RAM 60, back-up RAM 61, a group of counters and timers 62, SCI 63 which is a serial communication interface, I/O interface 64, and a bus line 65 for connecting those elements each other.

The group of counters and timers 62 generally includes, for the sake of convenience, various counters such as a free-run counter and a counter for counting input pulses of a cam angle sensor signal, and various timers such as a fuel injection timer, an ignition timer, a periodical interruption timer for imposing a periodical interruption, a timer for timing interval of crank angle sensor signals and a watch dog timer for monitoring a system abnormality. In the main computer 51, various other software counters and timers are used.

The sub-computer 52 is also, similar to the main computer 51, a micro-computer having CPU 71, ROM 72, RAM 73, a group of counters and timers 74, SCI 75, I/O interface 76, and a bus line 77. The main computer 51 and the sub-computer 52 are connected with each other by the serial communication line through the SCIs 63 and 75.

The I/O interface 64 of the main computer 51 has an input port, to which are connected the intake air amount sensor 32, the throttle opening degree sensor 33, the coolant temperature sensor 36, the 02 sensor 37, the intake air pressure sensor 22, a vehicle speed sensor 42, an atmospheric pressure sensor 44, and the battery 55 through an A/D converter 66, and connected the idling switch 33*b*, the crank angle sensor 39, the cam angle sensor 4*l*, a radiator fan switch 43, an air conditioner switch 45, and a shift switch 46 for detecting a shift position of an automatic transmission, and further connected various sensors and switches not shown.

In the case of a vehicle having a manual transmission (MT vehicle), a neutral switch for detecting the neutral of the shift position is used in place of the shift switch 46. However, the neutral switch may be omitted.

The I/O interface 64 has an output port, to which are connected through a drive circuit 67 the igniter 27, and connected the ISCV 16, the injector 25, a relay coil of the fuel pump relay 57, and the duty solenoid valve 21, and further connected various actuators not shown.

Thus, in the main computer 51, various jobs relating to the input signal processing, fuel injection control, ignition timing control and idling speed control are executed effectively under the control by a single operating system (OS). This OS has various management functions for vehicle control and an internal strategy closely related to the management functions, and systematically combines various jobs so as to efficiently execute various jobs.

Moreover, the I/O interface 76 of the sub-computer 52 has an input port, to which are connected the crank angle sensor 39 and the cam angle sensor 4*l* as well as connected the knocking sensor 34 through an A/D converter 78, a frequency filter 79 and an amplifier 80. The sub-computer 52 processes a signal from the knocking sensor 34 and determines if the knocking occurs in the engine.

An output port of the I/O interface 76 of the sub-computer 52 is connected to the input port of the I/O interface 64 of the main computer 5*l* to transmit the result of determination of the knocking in the sub-computer 52 to the I/O interface 76. In response to such the transmission, the main computer 5*l* reads knocking data from the sub-computer 52 through the serial communication line and the SCIs 63 and 75, and delays the ignition timing of a specific cylinder on the basis of the knocking data to avoid knocking.

In the following, the idling speed control by the main computer 51 will be described in detail. Since the sub-computer 52 is used only for detecting and processing the knocking, the explanation of operation thereof will be omitted.

Figure 16:
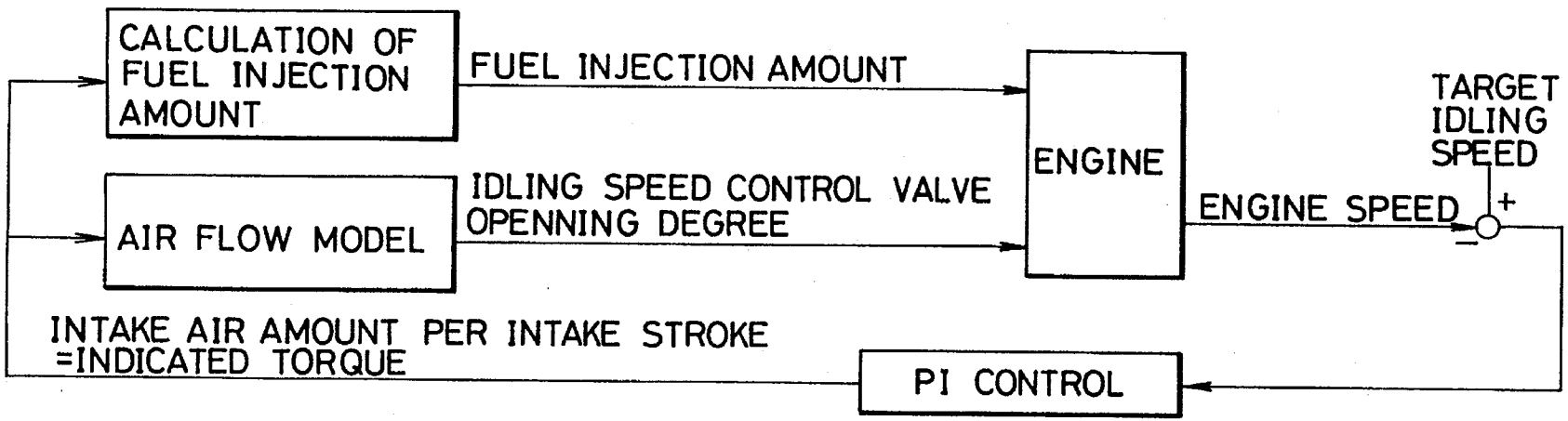
FIG. 16 is a block diagram of the idling speed control of the present invention.

Basic idea of the idling speed control according to the present invention is explained by FIG. 16.

Essentially, an engine torque is a suitable parameter which should be controlled for the idling speed control. However, since such the engine torque can not be handled directly, a target physical amount regarded to be a linear relation with the indicated torque of the engine is handled as a controlled parameter by a PI controller instead. Therefore, the PI controller provides a target value of the target physical amount per intake stroke in response to a change in the idling speed. A fuel injection amount to be injected during the idling state is determined on the basis of the target value of the intake air amount per intake stroke, and an opening degree of the ISCV 16 is also determined using the computation results of an intake system model formula along with the calculation of the fuel injection amount so as to supply to the cylinder an intake air amount adapted to the determined fuel injection amount.

Thus, during idling, there is not employed such a conventional procedure that measuring an intake air amount by a sensor and determining a fuel injection amount based on the measured intake air amount. Therefore, the aforementioned problem of the measurement delay set forth in item (3) can be completely eliminated. The air flowing delay into an intake chamber described in item (2) is also minimized.

Furthermore, with respect to the aforementioned mechanical delay in response of the ISCV set forth in item (1) and the fuel transport delay set forth in item (4), since the fuel injection is performed simultaneous with the adjustment of the ISCV, the mechanical delay of the ISCV and the fuel transport delay also occur simultaneously, not be superposed or accumulated, thereby further decreasing the delay in response of the engine torque change.

In the present embodiment, an intake air amount Ga per intake stroke (unit; mg/cycle) defined by an intake air mass per intake stroke of one cylinder is used as the target physical amount, that is, the controlled parameter of the PI controller. The intake air amount Ga per intake stroke can be considered to be a linear relation with the indicated torque of the engine. The intake air amount Ga per intake stroke can be obtained from a map which is experimentally obtained with the engine speed as a parameter. Instead of the intake air amount per intake stroke, an absolute intake air pressure or fuel injection amount can be used as the target physical amount.

Figure 17:
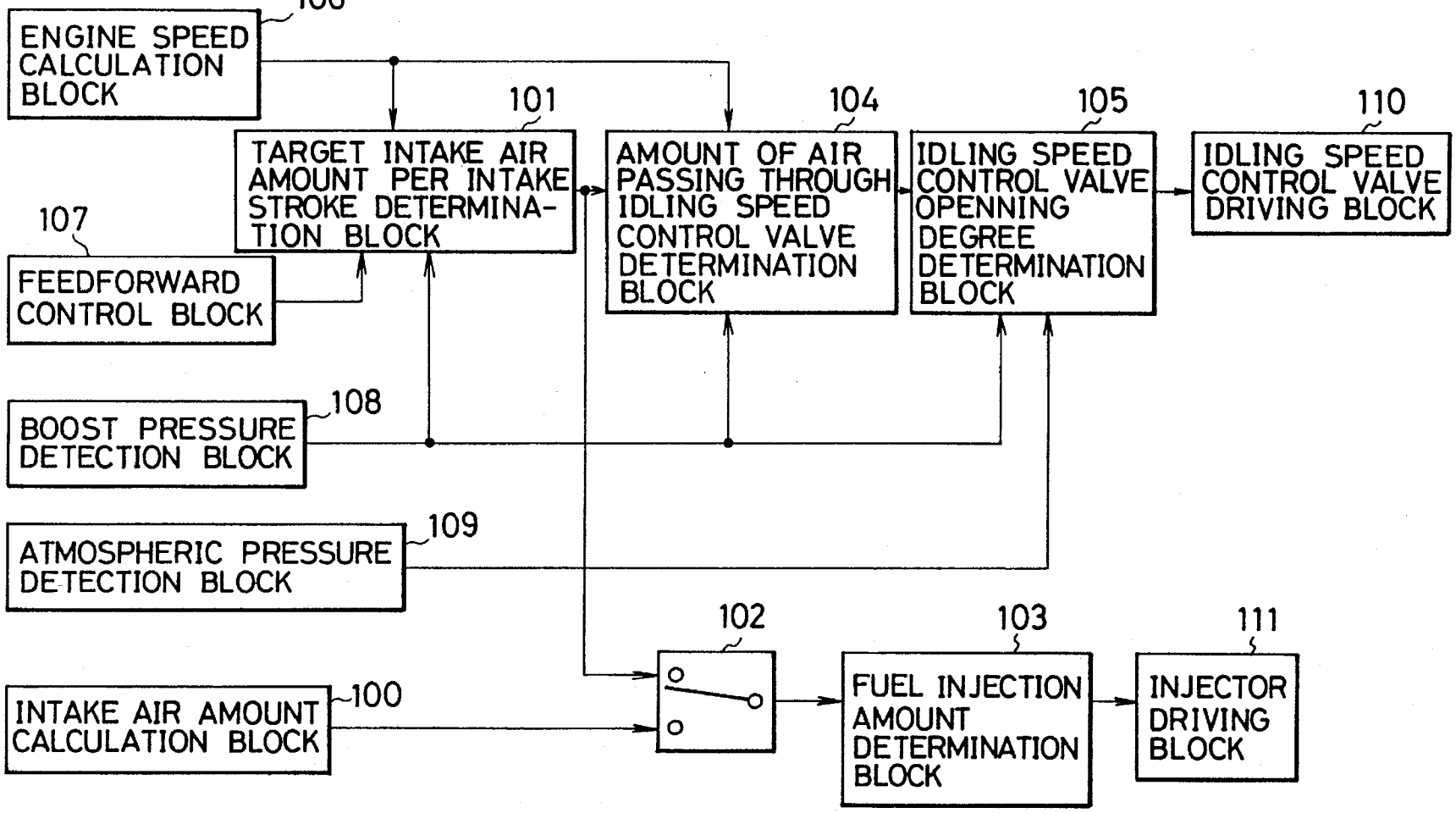
FIG. 17 is a functional block diagram of a control unit in connection with the idling speed control of the present invention.

FIG. 17 is a functional block diagram of the ECU 50 (main computer 51) showing the embodiment according to the present invention.

An intake air amount processing block 100 processes a signal indicative of an intake air amount Q detected by the intake air amount sensor 32. An engine speed calculation block 106 calculates an engine speed Ne based on the time interval of signals from the crank angle sensor 39.

In usual, when the idling switch **33*b* is OFF (not idling state), an usual control/idling speed control switching block 102 switches to feed the calculated intake air amount Q to a fuel injection amount determination block 103** to calculate a fuel injection amount Ti according to a known L-Jetronic system. By the L-Jetronic system, a basic fuel injection amount Tp is set from the intake air amount Q and the engine speed Ne, and the basic fuel injection amount Tp is corrected by various correction items corresponding to the engine operating condition to determine a final fuel injection amount Ti.

During the idling state, since the idling switch 33b is turned 0N (idling state), the usual control/idling speed control switching block 102 switches to feed to the fuel injection amount determination block 103 a target value (Gaset) of the intake air amount Ga per intake stroke determined by a target intake air amount per intake stroke determination block 101 to calculate a fuel injection amount Gf according to the present invention. The fuel injection amount Gf (unit; mg/cycle) during the idling state is calculated from such the target value Gaset, using the following Equation (1).

$$Gf = Gaset \times (F/A) \quad (1)$$

where F/A; target fuel and air ratio.

Then, the fuel injection amount Gf calculated by the above Equation (1) is multiplied by, for example, a suitable coefficient, whereby it can be converted into a basic fuel injection amount Tp, providing a final fuel injection amount Ti in the similar manner to the nonidling state.

As shown by the Equation (1), it is clear that the intake air amount Ga per intake stroke is equivalent to the fuel injection amount Gf since the target fuel and air ratio (F/A) is a constant. Thus, changing the intake air amount Ga per intake stroke according to the present invention is equivalent to directly changing the fuel injection amount. That is, the idling speed control according to the present invention can be called as "fuel leading type" control.

In addition, with respect to the conventional system where the fuel injection amount is calculated from the intake air amount detected by the sensor, in the case where the excessive amount of intake air is induced into the cylinder due to the stick of the ISCV 16 at full open, the fuel injection amount thus calculated is also excessively increased irrespective of the demand of the engine.

In contrast, with respect to "fuel leading type" idling speed control according to the present invention, such a malfunction does not occur, and the safety can be secured.

The determination of the target value Gaset of the intake air amount per intake stroke by the target intake air amount per intake stroke determination block 101 will be describe hereinafter.

The target value Gaset can be determined in association with a Ga-Ne map experimentally obtained with the engine speed being a parameter. However, as will be described later, when the engine speed Ne is less than a reference speed (a cranking speed) Nst at cranking, the target value Gaset is calculated on the basis of an actual absolute intake air pressure (boost pressure) P measured by the intake air pressure sensor 22 and processed by an intake air pressure processing block 108 of the ECU 50.

Figure 18:
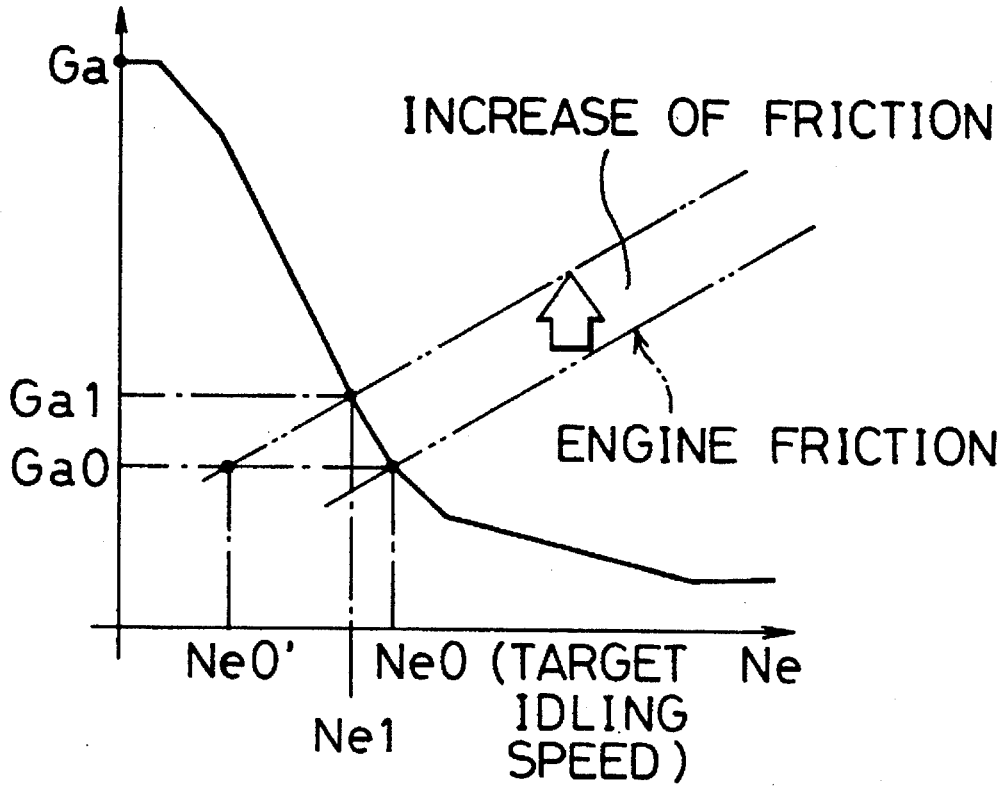
FIG. 18 is an explanatory view of the proportional control by a Ga—Ne map.

First, the Ga-Ne map of the intake air amount per intake stroke, as shown in FIG. 18, will be described. To arrange the Ga-Ne map, an intake air amount Ga0 per intake stroke required to generate an indicated engine torque in equilibrium with a friction of the engine at a target idling speed Ne0 is experimentally obtained. With this intake air amount Ga0 per intake stroke at the target idling speed Ne0 as the central figure, the Ga-Ne map is configured such that larger target value of the intake air amount per intake stroke is set with smaller engine speed Ne so as to increase the engine torque, whereas smaller target value of the intake air amount per intake stroke is set with larger engine speed Ne so as to decrease the engine torque. Thus, as shown in FIG. 18, the Ga-Ne map is depicted by a line characteristic of a decrease function of the intake air amount Ga per intake stroke with the increase of the engine speed.

Assuming the case where the engine friction increases due to the increase of the engine load, if the intake air amount per intake amount is kept at Ga0, the engine speed would excessively drop to a speed Ne0', as shown in FIG. 18, at which the indicated engine torque caused by the intake air amount Ga0 per intake stroke is in equilibrium with the increased engine friction. However, according to the present invention, when the engine speed decreases due to the increase of the engine load, the intake air amount per intake stroke is increased along the characteristic line. Consequently, when the engine speed decreases to a speed Ne1, the indicated engine torque caused by an intake air amount Ga1 per intake stroke provided at the engine speed Ne1 becomes equilibrium with the engine friction, whereby the engine speed is converged to Ne1 and stabilized.

The foregoing control corresponds to a proportional control (P control) by the PI controller.

The proportional control described above can improve the transient stability or the convergence property of the idling speed against the immediate engine load change. However, it is difficult to completely eliminate a deviation of the converged idling speed from the target idling speed. That is, as shown in FIG. 18, when the engine load increases, the intake air amount per intake stroke is increased to Ga1 to prevent the engine speed from excessively dropping, but the engine speed converges to the speed Ne1 offset from the target idling speed. To cancel such an offset of the idling speed from the target, an integration control (I control) by the PI controller is required.

Figure 19A:
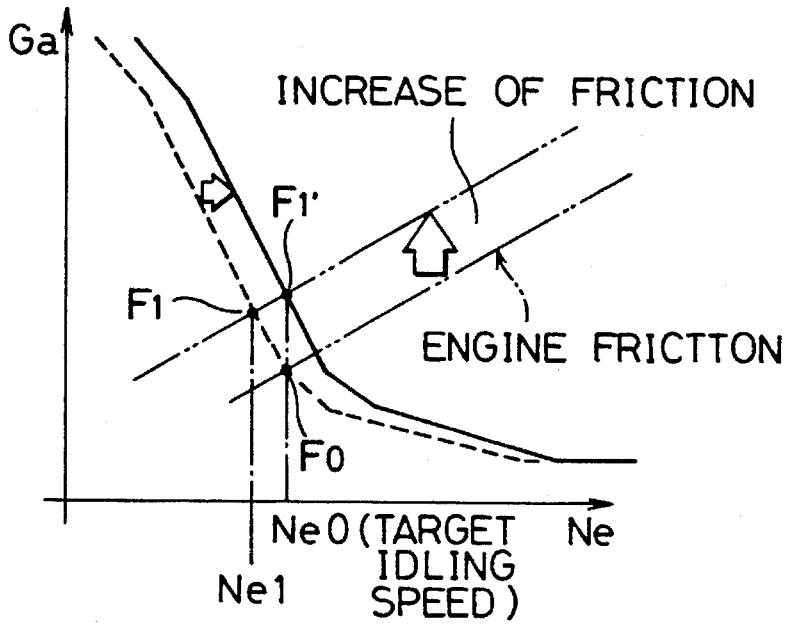
FIG. 19(*a*) and 19(*b*) are explanatory views of the integration control by the Ga—Ne map.
Figure 19B:
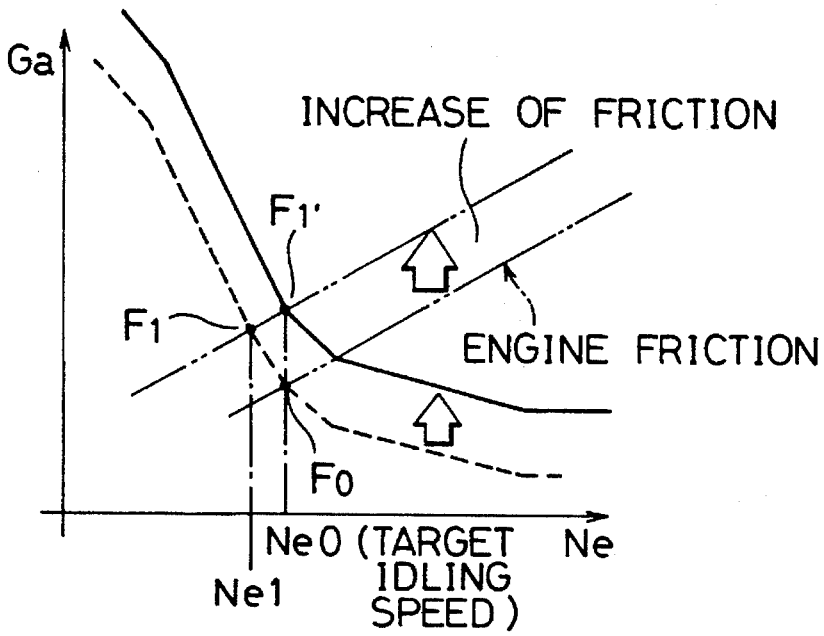
Figure 20:
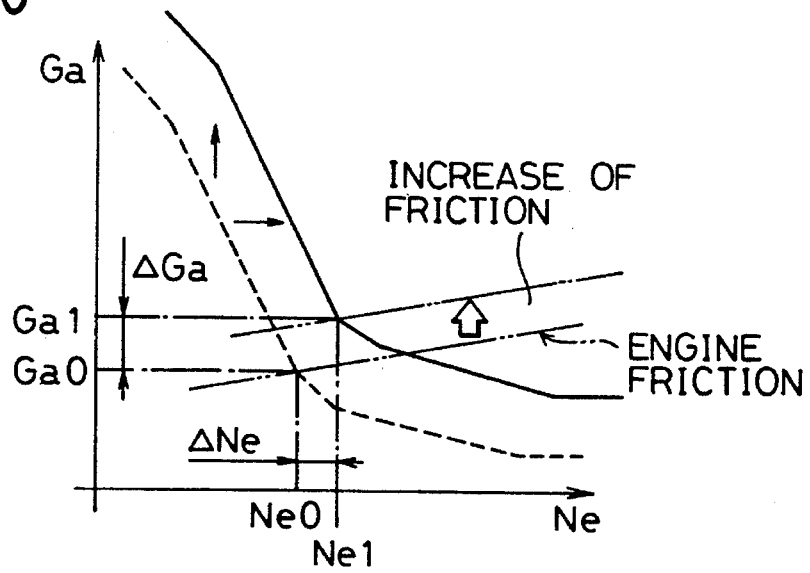
FIG. 20 is an explanatory view showing the movement of the Ga—Ne map at the time of low coolant temperature and at the time of load change.

To schematically explain the process of the I control by means of the Ga-Ne map shown in FIG. 19(*a*), an equilibrium point of the engine friction and the intake air per intake stroke corresponding to the indicated engine torque is displaced from an offset position F1 to a position F1' at the target idling speed Ne0 by gradually parallel-displacing the characteristic line along a Ne axis from a doted line position to a solid line position. Additionally, as shown in FIG. 19(*b*), the characteristic line may be gradually parallel-displaced along a Ga axis from a doted line portion to a solid line portion to displace such an equilibrium point from F1 to F1'.

In addition to the P control and the I control described above, a feedforward control can be performed by a feedforward control block 107 to increase at least one of the target idling speed (high idling speed) and the engine torque in advance before the engine friction increases so as to improve the responsibility of the idling speed control. This sort of feedforward control is applied to the case where the increase of the engine friction is predictable or expected, such a case being detected by a switch or sensor.

In the case where a coolant temperature is low or an air conditioner is turned ON, the characteristic line of the Ga-Ne map is displaced along the Ne axis by a target speed feedforward displacement ΔNe, and along the Ga axis by an intake air feedforward displacement ΔGa corresponding to the expected load increase, whereby the engine torque is in equilibrium with the increased engine friction at the high idling speed.

Following table lists various engine loads which the feedforward control will be applied by the feedforward control block 107, and indicates the availability of the target speed feedforward displacement ΔNe and the intake air feedforward displacement ΔGa for the respective engine loads.

| Load | Availability of Ga and Ne |
|---|---|
| Coolant temp. | Variable depending on coolant temp. (map value) |
| Air conditioner | Available at air conditioner switch ON |
| Shift change | Available at shift to 1, 2, D, or R range |
| Battery voltage | Variable depending on voltage (map value) |
| Radiator fan | Available at radiator fan switch ON (Ne not available) |

Figure 26A:
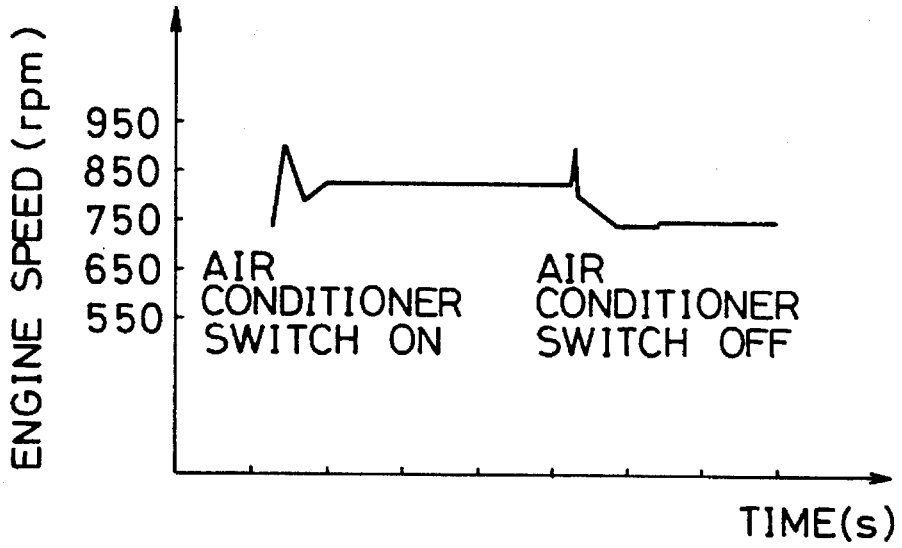
FIGS. 26(*a*) and 26(*b*) are explanatory views showing the speed convergence property when an air conditioner is turned ON and OFF.
Figure 26B:
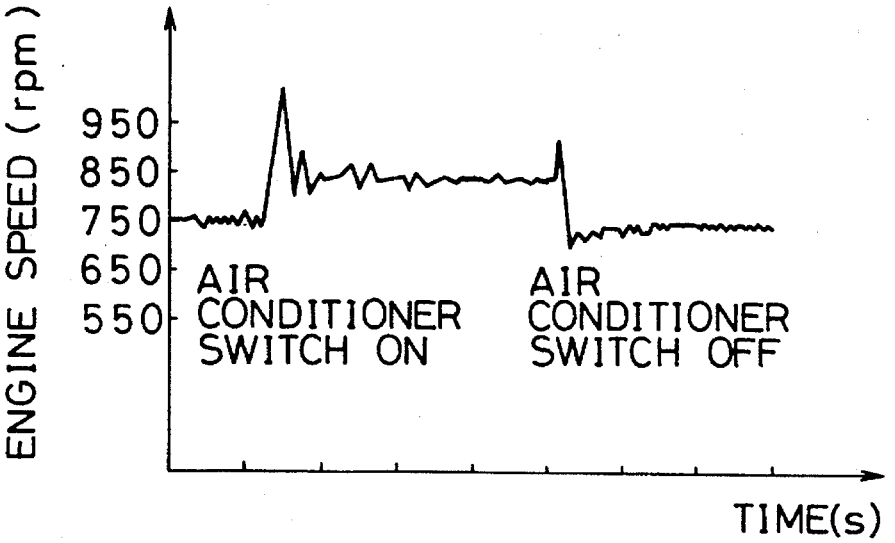

FIGS. 26(*a*) and (*b*) shows the overshoot and undershoot of the engine speed caused when, for example, the air conditioner switch is switched over. As compared with the conventional idling speed control shown in FIG. 26 (*b*), the overshoot caused immediately after the air conditioner switch is turned ON and the undershoot caused after the air conditioner switch is turned OFF are comparatively small and no fluctuation in speed occurs during the air conditioner being ON with respect to the present invention as shown in FIG. 26 (*a*).

Figure 27A:
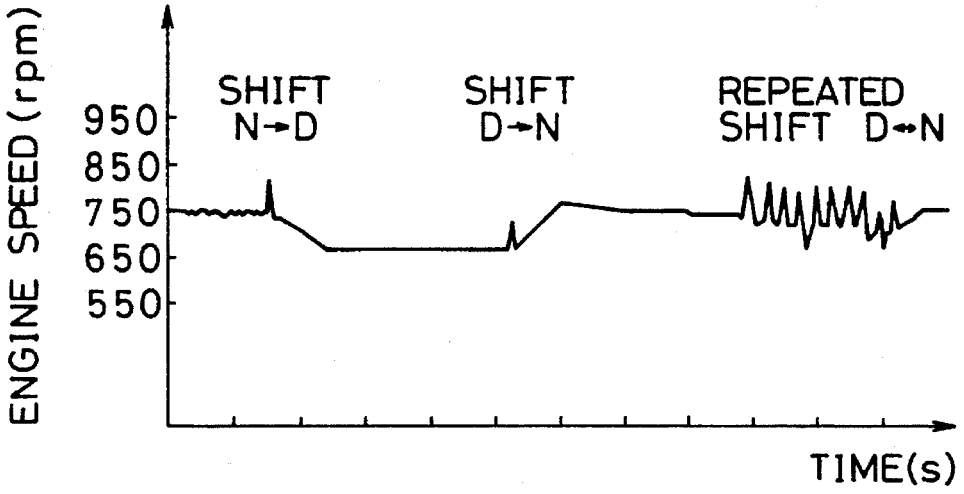
FIG. 27(*a*) and 27(*b*) are explanatory views showing the speed convergence property depending on the shift change.
Figure 27B:
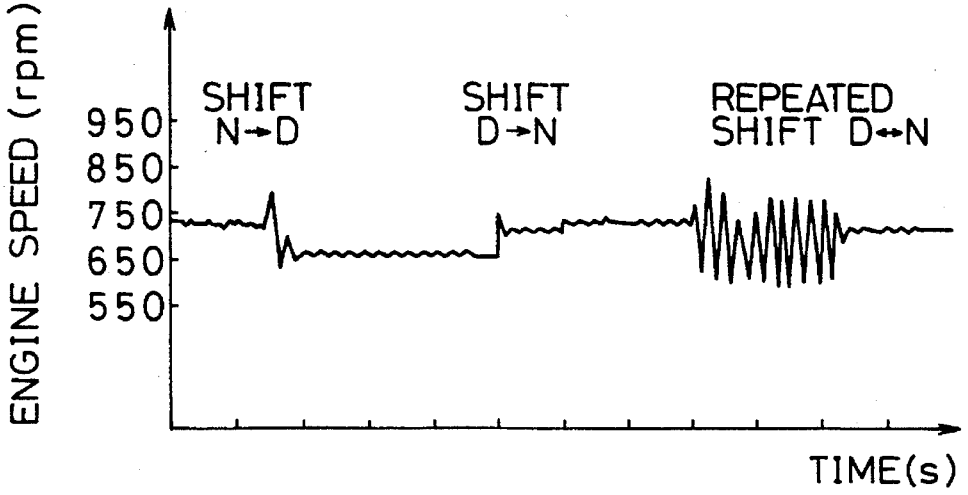

Moreover, FIGS. 27(*a*) and (*b*) shows the variation in engine speed caused by a change in shift position of an automatic transmission. In the case of the shift between a neutral (N) range and a drive (D) range, or the continuous repetition of these shifts, the variation in engine speed of the present invention is smaller, as shown in FIG. 27(*a*), than that of the conventional idling speed control shown in FIG. 27(*b*). In the case of the shift from the D range to the N range, the target engine speed rises gently by gradually changing the target speed feedforward displacement ΔNe to displace the characteristic line in the Ga-Ne ,nap whereas the intake air feedforward displacement ΔGa is changed stepwisely.

Figure 21:
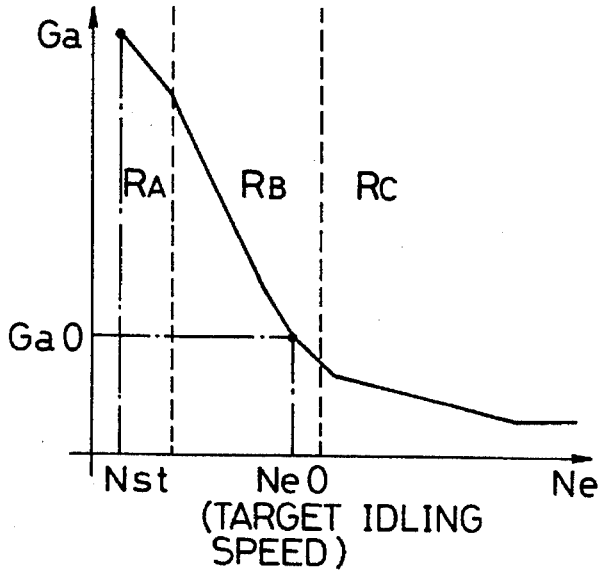
FIG. 21 is an explanatory view showing the characteristics of the Ga—Ne map.

The Ga-Ne map is, as shown in FIG. 21, defined by three areas RA, RB and RC with the engine speed. The characteristic line in each area is arranged as follows.

Figure 28A:
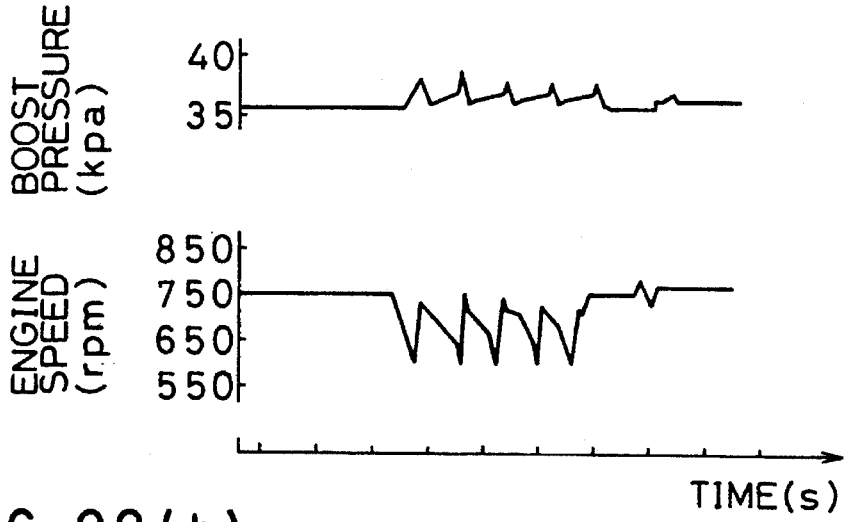
FIGS. 28(*a*), (*b*) and (*c*) are explanatory views showing a relationship between the strength of proportional control and variations of engine speed and intake air pressure.
Figure 28B:
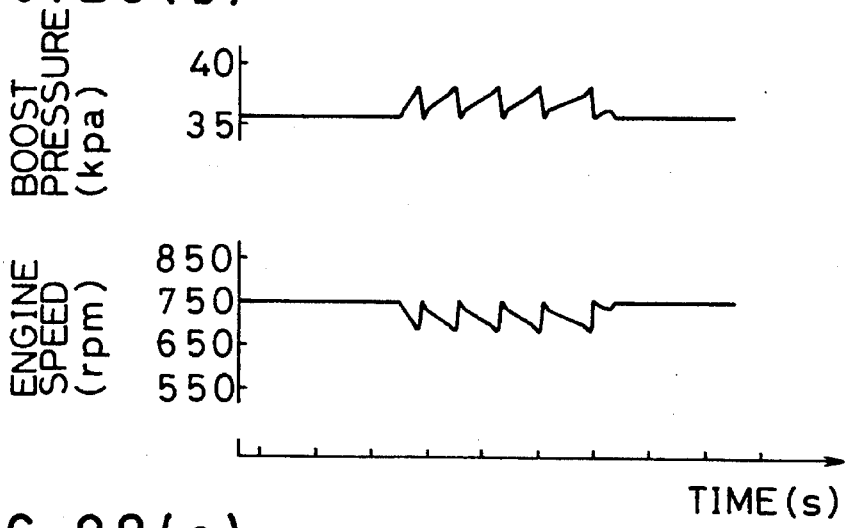
Figure 28C:
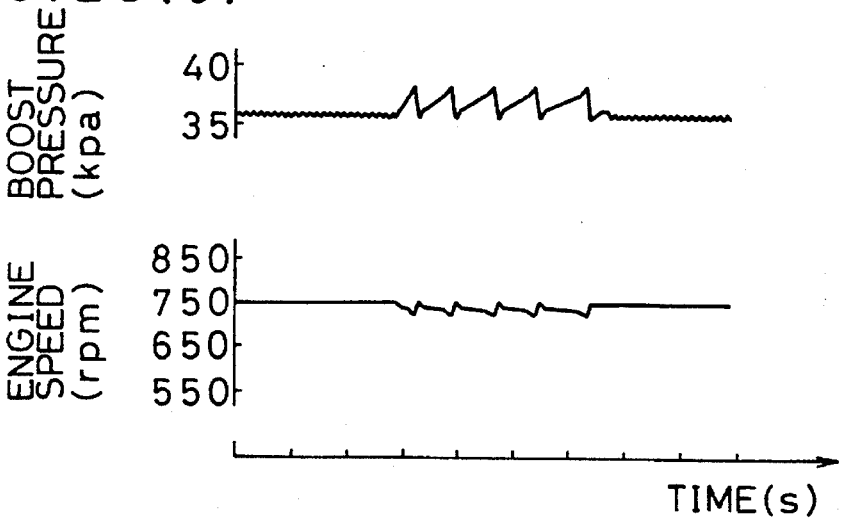

With respect to the area RB, since the area RB contains the target engine speed Ne0, the magnitude of the inclination of the characteristic line therein is important to prevent fluctuations in the engine speed at the time when the engine load change occurs. FIGS. 28(*a*), (*b*) and (*c*) show results of the test where fluctuations in the engine speed and fluctuations in the intake air pressure are observed depending on the inclinations (0.2 mg/rpm, 0.8 mg/rpm, 2.0 mg/rpm) of the characteristic line in the RB area at the time when the engine load change is applied by rotating a power-assisted steering wheel. It is acknowledged from FIGS. 28(*a*), (*b*) and (*c*) that fluctuations in the engine speed becomes small as the inclination becomes large, but as the inclination is too large, the intake air pressure unnecessarily fluctuates even at a steady state of the engine. Accordingly, the inclination of the characteristic line in the RB area is experimentally decided taking in account both the engine speed and the intake air pressure.

Second, the characteristic line in the RC area is arranged to be gradually curved so as to smoothly proceed to the idling speed after coasting or racing to avoid misfire of the engine.

Figure 22:
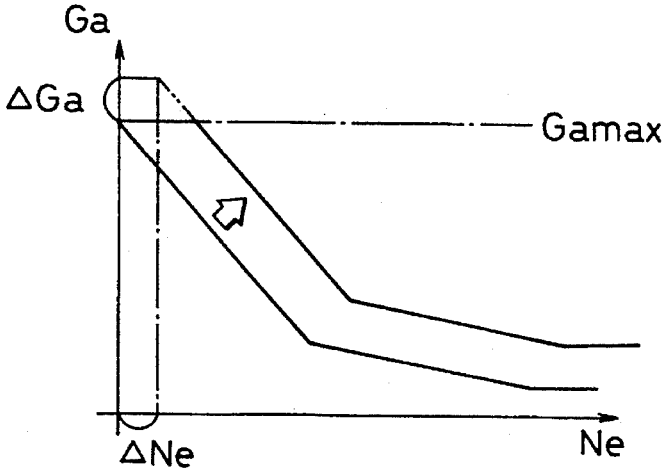
FIGS. 22 and 23 are explanatory views showing the control at start of an engine by the Ga—Ne map.
Figure 23:
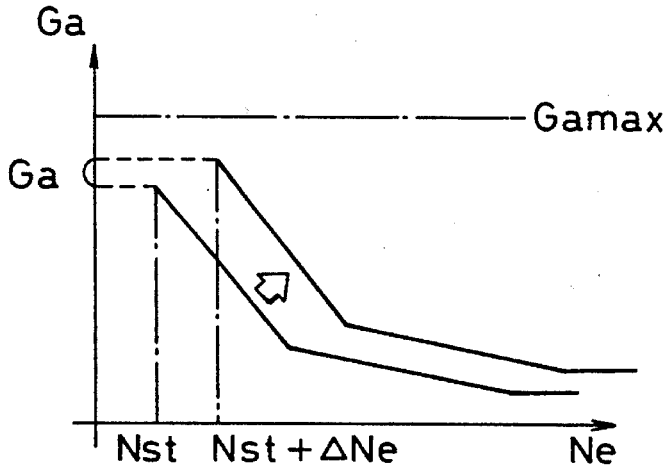
Figure 29A:
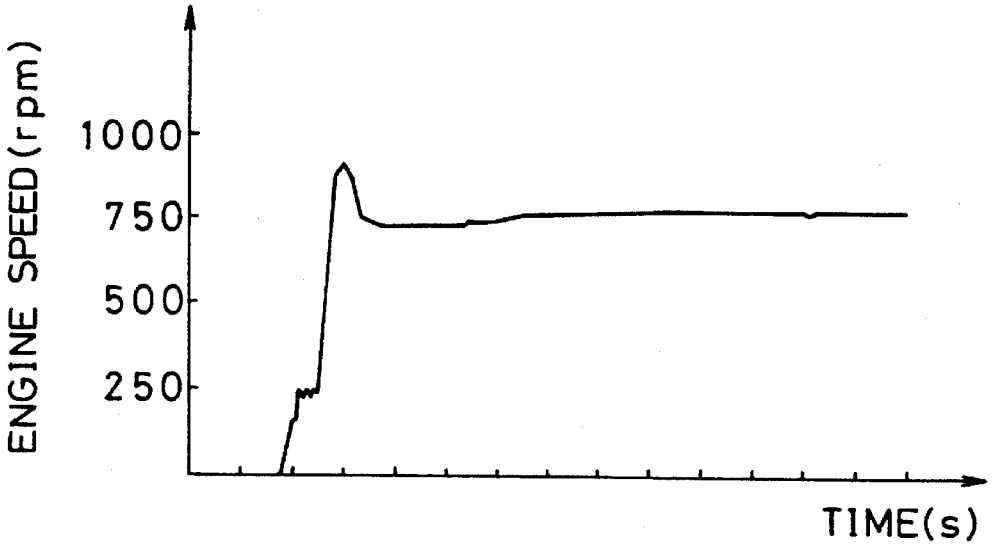
FIG. 29(*a*) and 29(*b*) are explanatory views showing the variations of engine speed at start.
Figure 29B:
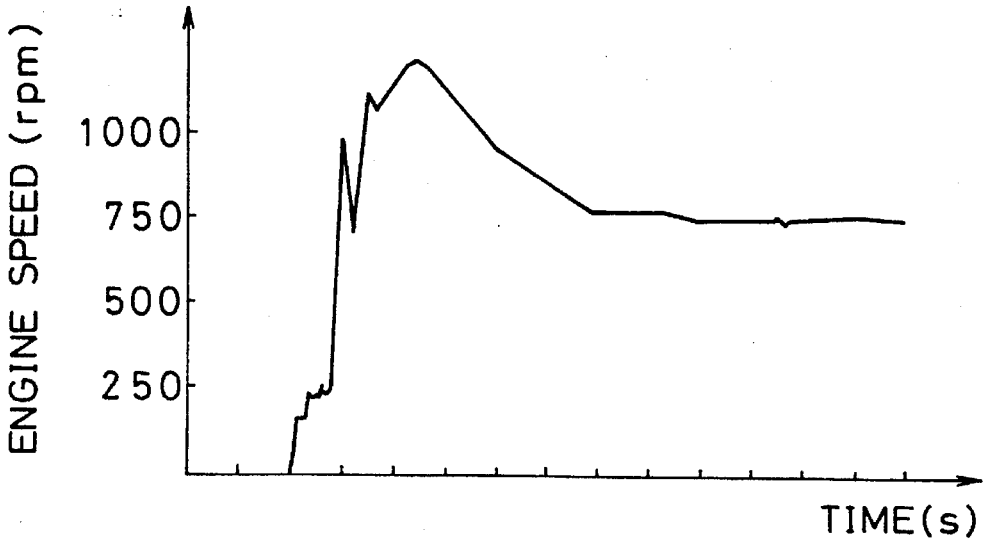

Moreover, in the RA area, the inclination of the characteristic line is arranged smaller than that in the RB area and no map value of the intake air amount per intake stroke is provided for the engine speed below the cranking speed Nst, so as to improve fluctuation in the engine speed at the engine start, especially at the cold start. That is, where map values are provided for the engine speed below the cranking speed as shown in FIG. 22, when the characteristic line is displaced by the predetermined intake air displacement ΔGa and the feedforward speed displacement ΔNe by the feedforward control as described above, an intake air amount over a maximum amount Gamax possible, in theory, to the engine would be required. Therefore, in the present embodiment, in the case where the engine speed is less than the cranking speed Nst, the intake air amount Ga per intake stroke is not given from the Ga-Ne map but the actual intake air pressure P detected by the intake air pressure sensor is used to calculate the fuel injection amount. In this case, when the engine speed exceeds the cranking speed Nst, the idling speed control depending on the Ga-Ne map begins. Furthermore, in the case where the characteristic line of the Ga-Ne map may be displaced by the above-described feedforward control, such a map dependent idling speed control begins from the displaced cranking speed Nst+ΔNe, as shown in FIG. 23. FIGS. 29(*a*) and (*b*) show overshoots of the engine speed at the engine start caused by the present invention and the conventional system, respectively. It is clearly recognized that the present invention can considerably minimize the overshoot of the engine speed at the start.

As described above, the characteristic line of the Ga-Ne map is displaced according to the I control and the feedforward control. Such a displacement of the characteristic line is achieved by using, on behalf of the engine speed, a map reference parameter IRPM calculated from an actual engine speed Ne, an integration amount FBN by the I control and a target speed feedforward displacement ΔNe by the feedforward control to refer to the Ga-Ne map. More specifically, in the preferred embodiment, the map reference parameter IRPM is calculated by adding the integration amount FBN to and further subtracting the target speed feedforward displacement ΔNe from the actual engine speed (IRPM←Ne+FBN−ΔNe).

An intake air amount per intake stroke derived from the Ga-Ne map in accordance with the map reference parameter IRPM is defined as a basic intake air amount Gabase per intake stroke. Then, an intake air feedforward displacement ΔGa provided by the feedforward control block 107 is added to thus derived basic intake air amount Gabase per intake stroke to obtain a target intake air amount Gaset per intake stroke.

Moreover, at the engine start where the map reference parameter IRPM is less than the cranking speed Nst, an actual intake air amount per intake stroke is calculated from the actual intake air pressure P detected by the intake air pressure sensor 22, and the actual intake air amount per intake stroke is used as the target intake air amount Gaset per intake stroke.

Figure 24:
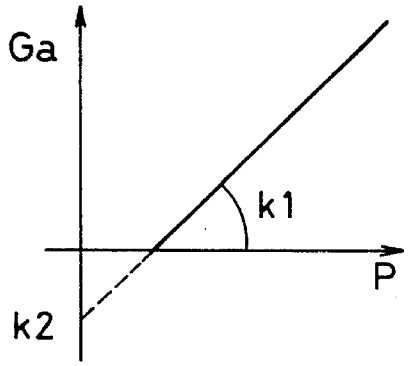
FIG. 24 is an explanatory view showing a relationship between an intake air amount per intake stroke and an intake air pressure.

As shown in FIG. 24, it is experimentally confirmed that the intake air amount Ga per intake stroke and the intake air pressure P are in a simple primary relation described by the following Equation (2). This relation varies in accordance to the engine speed but is assumed, in the present embodiment, to be maintained during the idling speed control.

$$Ga=K1\times P-K2 \quad (2)$$

where K1 and K2 are constants.

In more detail, the above Equation (2) can be represented by the following Equation (3).

$$Ga=K3\times P\times Vcy/(R\times T)-K2 \quad (3)$$

where Vcy is cylinder volume, R gas constant, T intake temperature, K3 constant.

Although it is mentioned above that the actual intake air amount Ga per intake stroke at the cranking is calculated from the actual intake air pressure P, actually the Equation (3) is used for such a calculation in the present embodiment.

Although the above Equation (3) includes a factor of an intake air temperature T, an intake air temperature sensor is not provided in the present embodiment because a fuel injection control according to the L-Jetronic system is employed at the non-idling. However, the intake air temperature T can be regarded to be equal to a coolant temperature TW because a coolant passage of the engine is provided aside the bypass passage 15 which supplies intake air for idling. A term R×T in the above Equation (3), which is a function of the temperature, is substituted by a temperature function M indicated by the following Equation (4).

$$M=R\times TW \quad (4)$$

The target air amount Gaset per intake stroke determined by the target intake air amount per intake stroke determination block 101 in the manner as described above is output to the fuel injection amount determination block 103 through the switching block 102 so that the fuel injection amount Gf is calculated, and at the same time, output to an amount of air passing through idling speed control valve determination block 104 so that the amount Qisc of air passing through the ISCV 16 is determined.

In response to a signal from the amount of air passing through idling speed control valve determination block 104, an idling speed control valve opening degree determination block 105 sets an opening degree (duty ratio of a drive pulse signal) of the ISCV 16 in order that intake air mass being actually induced into the cylinder per intake stroke in a fine time Δt becomes equal to the calculated target intake air amount Gaset per intake stroke, and then the ISCV 16 is driven through an idling speed control valve driving block 110.

Essentially, the control of the intake air amount to the target intake air amount Gaset per intake stroke can be substituted by the control to a target intake air pressure Pset. Therefore, changing the actual intake air amount per intake stroke to the target Gaset is achieved by changing the intake air pressure P to the target intake air pressure Pset.

The theory used in the calculation by the amount of air passing through idling speed control valve determination block 104 is described hereinafter.

Figure 25:
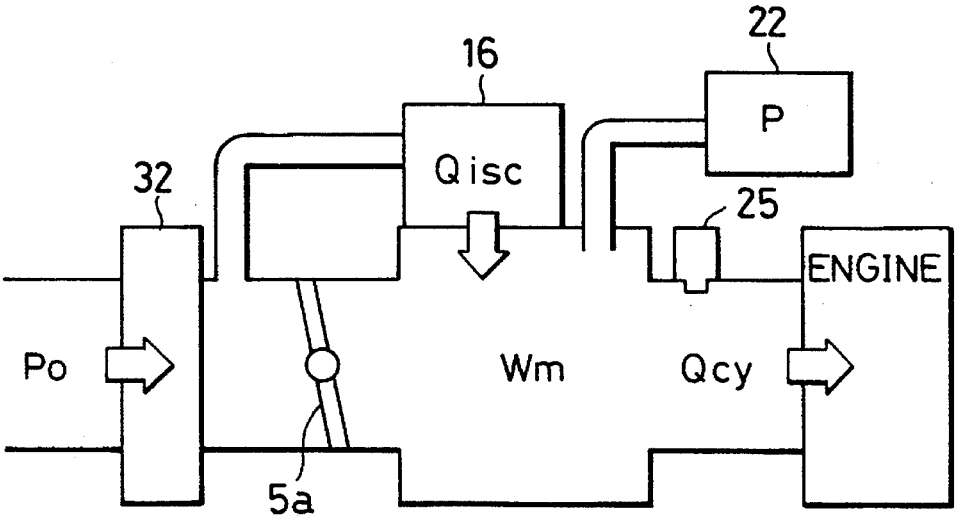
FIG. 25 is an explanatory view of a intake air chamber model.

Simplifying the intake system as a chamber model as shown in FIG. 25, a chamber is present between the throttle valve 5*a* and the intake port 2*a* of the engine. In this chamber model, air mass Wm (unit: g) stored in the chamber in the time Δt can be represented by a difference between mass of air passing through the ISCV 16 and flowing into the chamber in the time Δt, that is, an amount of air Qisc (unit: g/s) passing through the ISCV 16, and mass of air flowing into the cylinder from the chamber in the time Δt, that is, an amount of air Qcy (unit: g/s) flowing into the cylinder, which relationship can be represented by the following Equation (5).

$$(Wm(t+\Delta t)-Wm(t))/\Delta t=Qisc-Qcy \quad (5)$$

where Δt is a computation cycle time (for example 10 ms).

The above-described Equation (5) is a formula generally called as a chamber model formula. By reversing this Equation (5), it is considered that the amount of air passing through the ISCV 16 is consumed for the air mass stored in the chamber in the time Δt and air mass induced into the cylinder in the time Δt. By interchanging the air mass Wm in the Equation (5) based on the condition equation of gas and arranging the Equation (5) for the amount Qisc of air passing through the ISCV 16, the following Equation (6) can be obtained which is called as a reserved chamber model equation.

$$Qisc=(P(t+\Delta t)-P(t))\times V/(M\times\Delta t)+Qcy \quad (6)$$

where V is a chamber volume and M is a temperature function substituted for R×T.

Further, the amount Qcy of air flowing into the cylinder can be obtained from the engine speed Ne and the actual intake air amount per intake stroke calculated by the aforementioned Equation (3), as shown in the following Equation (7).

$$Qcy=Ne\times Ga\times(N/2)\times(1/60) \quad (7)$$

where N is the number of cylinders.

The term P(t) in the above Equation (6) is the actual intake air pressure P at a certain time t, and the term P(t+Δt) is the target intake air pressure Pset corresponding to the target intake air amount Gaset per intake stroke after the time Δt and can be obtained by the following Equation (8) which is reversed to the aforementioned Equation (3).

$$Pset=(Gaset+K2)\times M/(K3\times Vcy) \quad (8)$$

In the idling speed control valve opening degree determination block 105, the opening degree (duty ratio) DUTY of the ISCV 16 is set in accordance with the amount Qisc of air passing through the ISCV 16 calculated by the Equation (6). Since the amount Qisc is mass flow rate under a predetermined basic intake air temperature Tbase, it must be corrected depending on the change in the intake air temperature T. In the present embodiment, as previously mentioned, since the intake air temperature T is substituted by the coolant temperature TW, the ratio of the coolant temperature TW to the basic temperature Tbase is used as a coolant temperature correction value HIQ (HIQ=TW/Tbase) to calculate a corrected amount Qisc' of air passing through the ISCV 16 as the Equation (9):

$$Qisc=Qisc\times HIQ \quad (9)$$

Figure 30A:
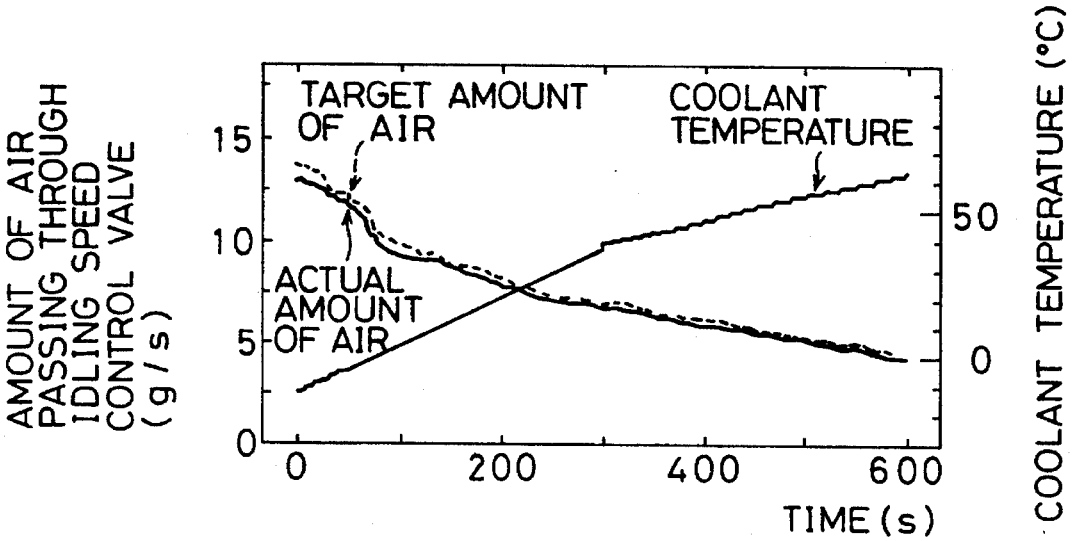
FIG. 30(*a*) and 30(*b*) are explanatory views showing a target valve and an actual measured valve of amount of air passing through an idling speed control valve (ISCV) caused by correction of coolant temperature.
Figure 30B:
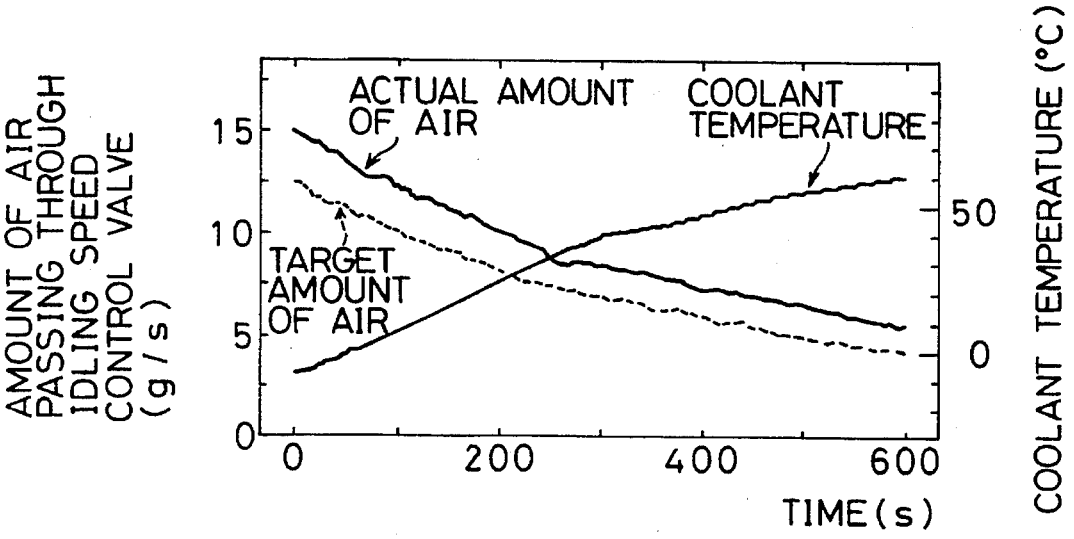

FIG. 30(*a*) shows the change in the amount of air passing through the ISCV 16 with time, one of plotted line indicating data calculated according to the reverse chamber model equation and corrected based on the coolant temperature, and the other indicating raw data actually detected. In contrast, FIG. 30(*b*) plots data calculated according to the reverse chamber model equation without correction of coolant temperature and raw data. It is understood from them that the correction based on the coolant temperature makes the calculation of the amount of air passing through the ISCV 16 accurate.

Figure 31:
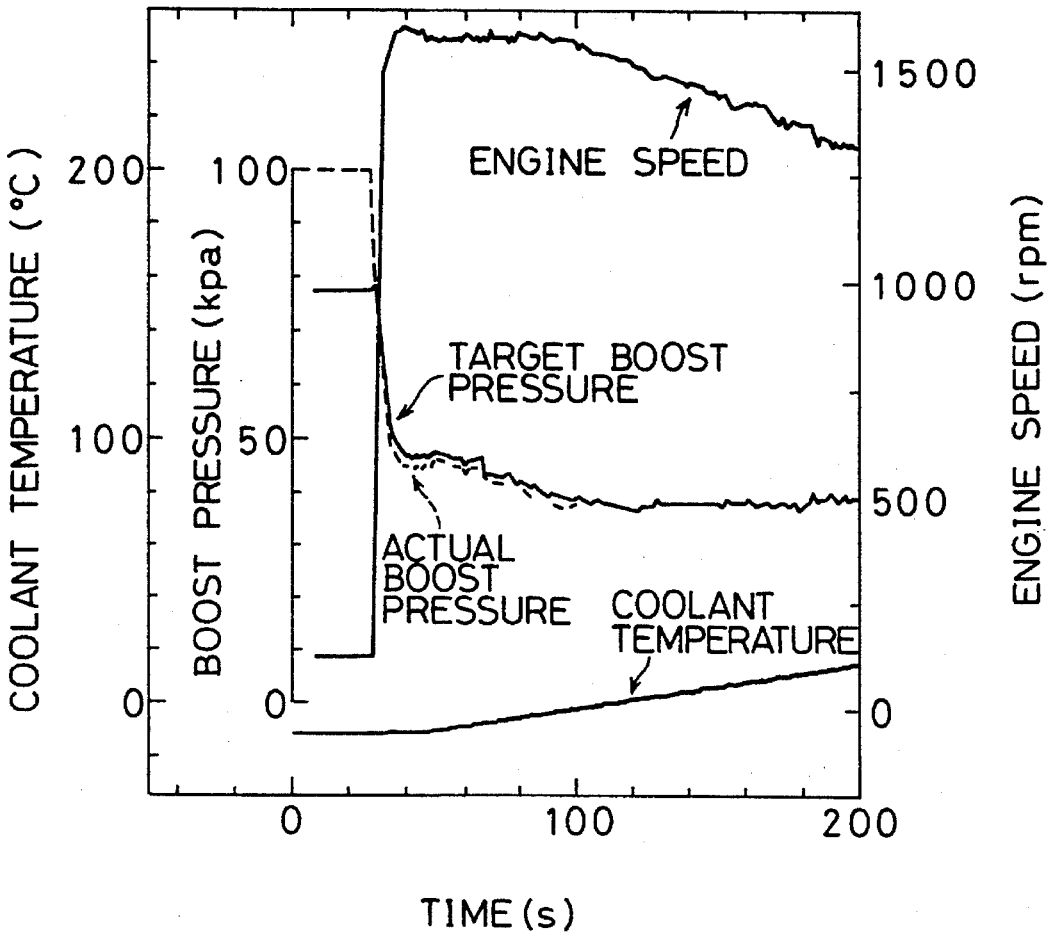
FIG. 31 is an explanatory view showing a target intake air pressure and an actual intake air pressure at cold start of the engine.

Further, as shown in FIG. 31, even at the engine start at a low temperature of −10 C., the target intake air pressure is substantially coincided with an actual intake air pressure. Even if the intake air temperature T is substituted by the coolant temperature TW, there poses no problem. The target engine speed is stabilized immediately after the start, and a good starting property at a low temperature can be obtained.

A duty ratio DUTY of the pulse signals for driving the ISCV 16 to obtain the corrected amount Qisc' of air passing through the ISCV 16 is determined by the corrected amount Qisc' and a pressure differential Pi before and after the ISCV 16, that is, a pressure differential between an atmospheric pressure PO and an intake air pressure P. The duty ratio DUTY can be represented by the following Equation (10) using a two-dimensional function f.

$$DUTY=f(Pi,\ Qisc) \quad (10)$$

where $$Pi=PO\times P.$$

The two-dimensional function f is complicatedly related to the construction of the ISCV 16 and it is difficult to obtain such the function f theoretically. Therefore, specifically, the duty ratio DUTY is experimentally obtained and formed into a two-dimensional duty ratio map with the pressure differential Pi and the corrected amount Qisc' of air passing through the ISCV 16 as parameters.

Figure 32A:
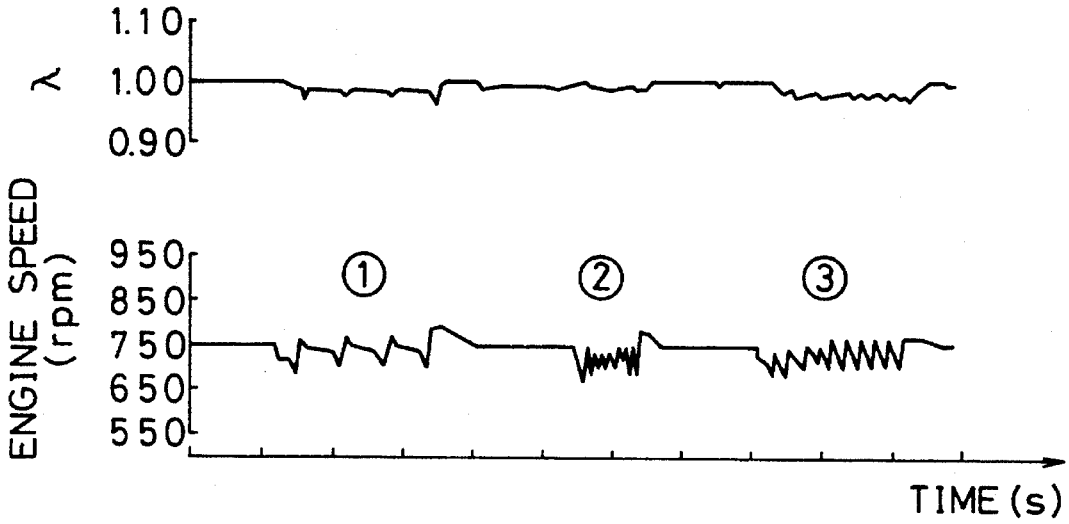
FIG. 32(*a*) and 32(*b*) are explanatory views showing the speed convergence property when a power steering is operated.
Figure 32B:
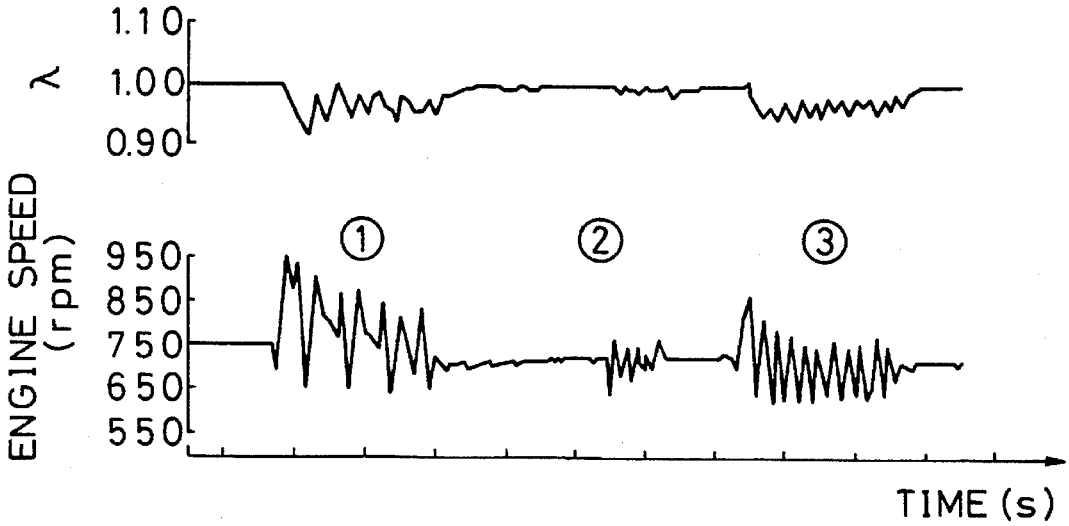

FIGS. 32(*a*) and (*b*) show fluctuations in engine speed in a state where the power-assisted steering wheel is gently rotated (see encircled numeral 1), a state where the power-assisted steering wheel is quickly rotated to a lock end (see encircled numeral 2), and a state where lock to lock steering is quickly made (see encircled numeral 3). As compared with the conventional idling speed control shown in FIG. 32(*b*), in the present embodiment shown in FIG. 32(*a*), the fluctuation in air surplus rate is apparently small as well as that in engine speed, which means that the controllability of an air-fuel ratio is superior.

To cope with the case where a carbon adhered to the ISCV 16 changes the characteristic thereof, correction by a learning value DUTYLR is applied to the duty ratio DUTY obtained from the two-dimensional duty ratio map to provide a final duty ratio DUTYisc as shown in the following Equation (11)

$$DUTYisc=DUTY+DUTYLR \quad (11)$$

Figure 33A:
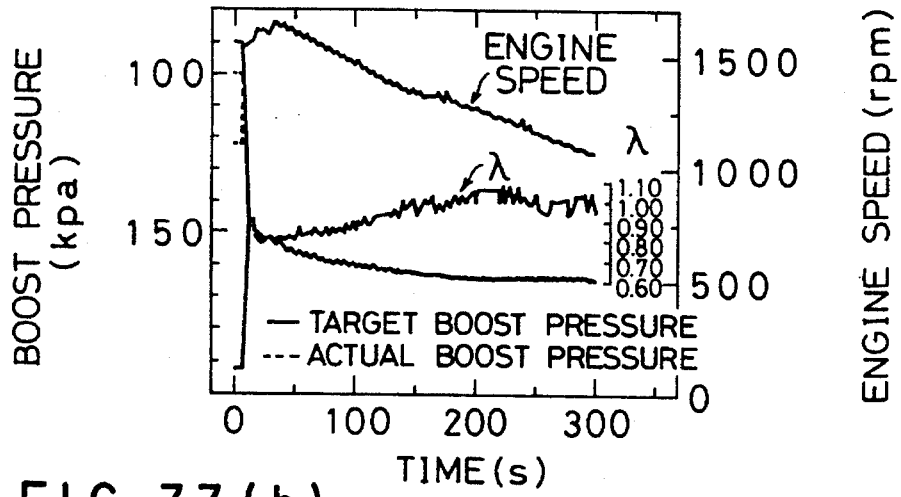
FIG. 33(*a*), (*b*) and (*c*) are explanatory views showing the learning with respect to the change in characteristics of the ISCV.
Figure 33B:
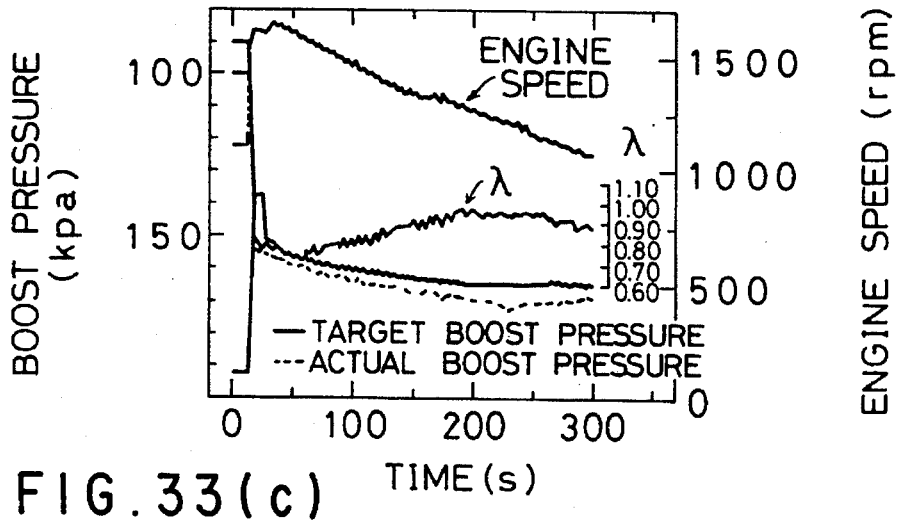
Figure 33C:
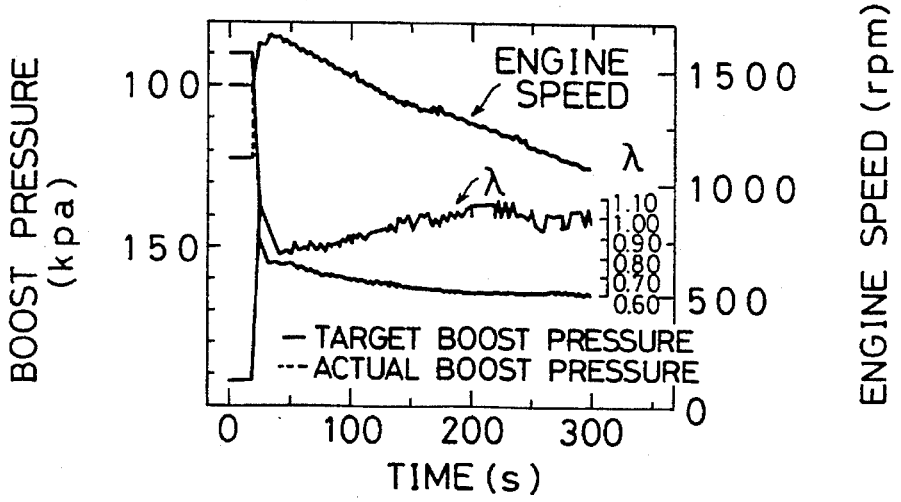

FIGS. 33(*a*), (*b*) and (*c*) show the effect of the learning correction when a carbon is adhered to the ISCV 16. FIG. 33(*a*) shows a case where the target boost pressure is in coincidence with the actual boost pressure since the carbon is not accumulated. FIG. 33(*b*) shows a case where the target boost pressure is not in coincidence with the actual boost pressure since the carbon is accumulated. If no learning correction is applied, the air surplus rate λ is shifted to the rich side although the engine speed is substantiality coincided with a normal initial state.

When the learning correction is applied in the above case, the target boost pressure is substantially coincided with the actual boot pressure, and the air surplus rate λ also indicates a value substantially identical to that of the normal initiate state.

In a system not provided with an atmospheric pressure sensor, an intake air pressure once detected after power is supplied to the system and before the engine starts can be equivalently adopted as an atmospheric pressure throughout the engine operation to calculate a pressure differential Pi before and after the ISCV 16.

Moreover, the duty ratio map may be simply employed as one dimensional map with only the amount Qisc' of air passing through the ISCV 16 as a parameter. In this case, the simple processing can be expected.

The chamber volume V in the aforementioned Equation (6) (the reversed chamber model formula) is a constant value determined according to the shape of the actual intake system, and further a gain of the amount Qisc of air passing through the ISCV 16. Therefore, the responsibility of the ISCV 16 depending on the duty ratio DUTYisc calculated based on the Equations (9) to (11) can be adjusted by changing the value of the chamber volume V.

Figure 34A:
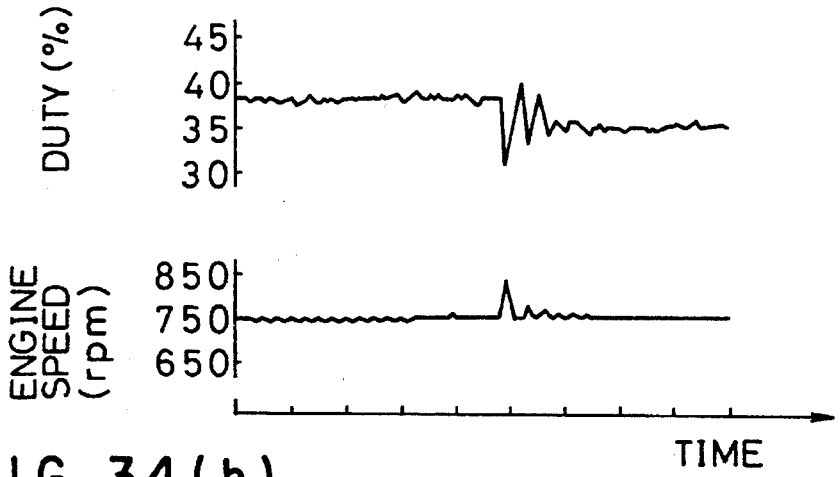
FIG. 34(*a*), (*b*) and (*c*) are explanatory views showing a variation in engine speed and a change in opening degree of the ISCV in the case where a value of a chamber capacity is changed in an arithmetic operation formula.
Figure 34B:
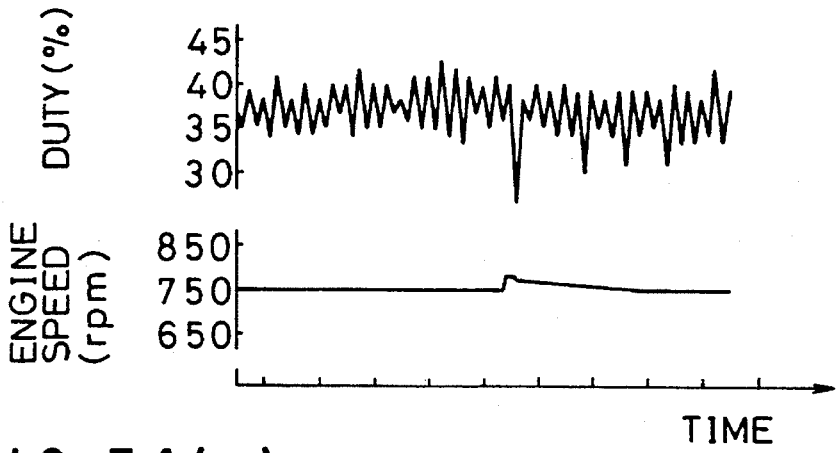
Figure 34C:
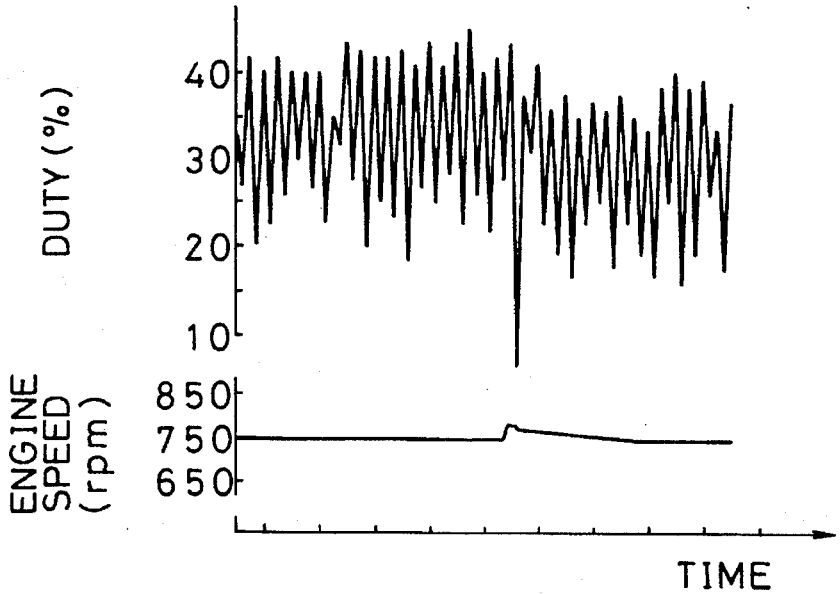

FIGS. 34(*a*), (*b*) and (*c*) show fluctuations in the engine speed and changes in the duty ratio DUTYisc when V=250 cc, V=1000 cc and V=2500 cc, respectively. As the value of the chamber volume V is larger, the duty ratio DUTYisc largely changes. However, when the chamber volume V is excessively small, the change in the duty ratio DUTYisc is small but the responsibility is deteriorated, as shown in FIG. 34(*a*), whereby the engine speed convergence at the engine load change becomes deteriorated. In contrast, when the chamber volume V is excessively large, it becomes too sensitive so that the change in the duty ratio DUTY becomes large as shown in FIG. 34(*c*), and finally, a valve intake sound is generated (it is noteworthy that even the duty ratio DUTYisc largely changes, the engine speed is stable). In practice, it is said that when the change in the duty ratio DUTYisc is within 10% as shown in FIG. 34(*b*), this is a level which poses no problem.

Thus, the chamber volume V in the aforementioned reverse chamber model equation can be used as a setting constant for setting the responsibility of the ISCV 16. This setting constant can be called a hypothetical chamber volume V' specifically represented by one obtained by multiplying the chamber volume V determined according to the shape of the intake system by a variable (response coefficient) r.

Accordingly, the aforementioned formula (6) for obtaining the amount Qisc of air passing through the ISCV 16 is replaced by the following Equation (12) whereby the setting of the responsibility of the ISCV 16 can be carried out at a manufacturing factory or a service station by changing the response coefficient r. In the present embodiment, the response coefficient r is, for example, of the order of r=0.5 to 2. When r=1, the following Equation (12) coincides with the normal reverse chamber model equation.

$$Qisc=(P(t+\Delta t)-P(t))/\Delta t\times r\times V/M+Qcy \quad (12)$$

Next, various jobs relating to the idling speed control will be described with reference to the flowcharts of FIGS. 1 to 11.

In the present embodiment, a job every 10 ms is employed as a basic routine to duty-control the ISCV 16. The fuel injection amount Gf is calculated by a job (for example, a crank angle synchronizing job) executed at a predetermined timing during one operation cycle of the engine on the basis of the target intake air amount Gaset per intake stroke calculated by the basic routine.

Parameters used for the basic routine performed every 10 ms are calculated every 50 ms and 250 ms and stored in predetermined addresses of the RAM 60. In each job every 50 ms, the integration amount FBN and the target speed feedforward displacement ΔNe are calculated. Further, in each job every 250 ms, the learning value DUTYLR, the coolant temperature correction value HIQ, the atmospheric pressure PO, and the temperature function M are calculated.

Prior to describing the basic routine every 10 ms, subroutines for calculating the parameters used in the basic routine will be first described.

With respect to the integration amount calculation subroutine shown in FIG. 4 executed every 50 ms, in Step S201 it is determined whether all the execution conditions noted in the following items (1) to (4) are fulfilled, that is, whether the engine is in the normal idling state.

(1) The engine is not in the stop state.

(2) The engine speed Ne is more than a predetermined speed which is lower than a target engine speed NSET, for example, NSET–200 rpm.

(3) The shift position of the automatic transmission is the N range or P range (in case of MT vehicle, the shift position is neutral).

(4) After the idling switch **33*b*** has been turned ON, the predetermined time has elapsed.

When there is even one condition not fulfilled among the above-described conditions, the program jumps to return. When all the conditions are fulfilled, the program proceeds from Step S201 to succeeding steps where an error between the actual engine speed Ne and the target engine speed NSET is integrated and the integration amount FBN is calculated according to an amount thus integrated.

In Step S202, determination is made whether or not the actual engine speed Ne obtained based on the signals from the crank angle sensor 39 is above an upper limit value NSET1 of the target engine speed. In the case where the actual engine speed Ne is above the upper limit value NSET1, Ne≧ NSET1, the control proceeds from Step S202 to Step S203 where a variable IDFE is reduced by a set value A and renewed (IDFE←IDFE–A), then proceeds to Step S206. Accordingly, as the event of Ne≧NSET1 continues, the variable IDFE becomes smaller every repetition of this sub-routine.

In Step S202, in case of Ne<(NSET1 to the contrary, the step proceeds from Step S202 to Step S204 where determination is made whether or not the actual engine speed Ne is lower than a lower limit value NSET2 of the target engine speed. In case of Ne≧NSET2 (in the case where the actual engine speed Ne is within an allowable range between the upper and lower limit values with respect to the target speed NSET), the program jumps to return holding the variable IDFE. In case of NE<(NSET2, that is, the actual engine speed Ne is lower than the lower limit value NSET2, the program proceeds from Step S204 to Step S205 where the variable IDFE is increased by a set value B and renewed (IDFE←IDFE+B), then proceeds to Step S206. Accordingly, as the event of Ne<NSET2 continues, the variable IDFE becomes larger every repetition of this sub-routine.

In Step S206 and thereafter, the integration amount FBN is calculated according to the variable IDFE which is an index representing the magnitude or degree of the error between the actual engine speed and the target engine speed. That is, in Step S206, determination is made whether or not the variable IDFE is above a set value C. In case of IDFE≧C, it can be so determined that the actual engine speed is too far from the lower limit of the target engine speed. Therefore, in Step S207, the integration amount FBN is decreased by a set value D (FBN←FBN–D). Then, after the variable IDFE is reset to an initial value in Step S210, the program returns.

Moreover, in case of IDFE<C in Step S206, the program is branched from Step S206 to Step S208 where determination is made whether or not the variable IDFE is smaller than a set value E. In case of IDFE≧E, since it can be so determined that the present integration amount FBN is suitable, the program jumps so as to hold the present integration amount FBN. In case of IDFE<E, it can be so determined that the actual engine speed is too far from the upper limit of the target engine speed. Therefore, the program proceeds from Step S208 to Step S209 where the previous integration amount FBN is increased by a set value F (FBN←FBN+F). Then, after the variable IDFE is reset in Step S210, the program returns.

Next, the sub-routine for calculating the target speed feedforward displacement ΔNe will be described with reference to FIGS. 5 and 6. As previously mentioned, the target speed feedforward displacement ΔNe is calculated in response to the state of the coolant temperature TW, the air conditioner switch 45, the battery voltage VB, and the shift switch 46. In this sub-routine, out of displacement factors ΔNeTW, ΔNeACON and ΔNeVB according to the states of the coolant temperature TW, the air conditioner switch 45, and the battery voltage VB, respectively, the largest one is adopted as the target speed feedforward displacement ΔNe. A displacement factor Δ NeD according to the state of the shift switch 46 is adopted as the target speed feedforward displacement ΔNe only when all the displacement factors Δ NeTW, ΔNeACON and ΔNeVB are "0".

Therefore, first, the displacement factor NeTW is derived from a map on the basis of the coolant temperature TW in Step S301 and is set as the target speed feedforward displacement ΔNe (ΔNe←ΔNeTW) in Step S302. The map of the displacement factor NeTW is defined such that the lower the coolant temperature, the value of displacement factor ΔNeTW increases as shown in the flowchart. In the present embodiment, "0" is provided as the displacement factor ΔNeTW for the coolant temperature TW larger than 80 C.

Subsequently, the program proceeds to Step S303 to determine whether the air conditioner switch 45 is in ON or OFF state. In case of the 0N state, the program proceeds to Step S304 where the displacement factor Δ NeACON is increased by a set value KS (ΔNeACON←ΔNeACON+KS). And then, in Step S305, determination is made whether or not the displacement factor ΔNeACON reaches an upper limit value (for example, 100 rpm). In the case where it is below the upper limit value (ΔNeACON≦100 rpm), the program jumps to Step S309. In case of reaching the value (ΔNeACON>100 rpm), the displacement factor ΔNeACON is fixed to the upper limit value in Step S306, and then the program proceeds to Step S309.

Thus, when the engine suffers an load for driving an air conditioner compressor in accordance with turning the air conditioner switch 45 on, the displacement factor ΔNeACON is gradually increased by the set value KS every repetition of this sub-routine until the displacement factor Δ NeACON reaches the upper limit value, thereby stabilizing the control property. After having reached the upper limit value, the displacement factor Δ NeACON is held at the upper limit value.

In the case where the air conditioner switch 45 is in OFF state in Step S303, the program proceeds to Step S307 where it is determined whether or not the displacement factor ΔNeACON reaches "0". When reaching "0" (Δ NeACON≦0), the program jumps to Step S309. When not reaching "0" (Δ NeACON>0), the displacement factor ΔNeACON is decreased by a set value LS (ΔNeACON←ΔNeACON−LS) in Step S308, and then the program proceeds to step S309.

That is, when the air conditioner switch 45 is switched to the OFF state from the ON state, the feedforward displacement factor ΔNeACON is gradually decreased by the set value LS until it reaches "0" to stabilize the control property.

In Step S309, the displacement factor ΔNeACON is compared with the displacement factor according to the coolant temperature TW which is already set as the target speed feedforward displacement ΔNe in Step S302. In case of ΔNe≧ΔNeACON, the program jumps to Step S311. In case of ΔNe <ΔNeACON, the displacement factor ΔNeACON replaces as the target speed feedforward displacement ΔNe (ΔNe←ΔNeACON ). Then, the program proceeds to Step S311.

In Step S311, the displacement factor ΔNeVB is derived from a map on the basis of the battery voltage VB. The map is defined such that the lower the battery voltage VB, the displacement factor ΔNeVB increases, as shown in the flowchart. In the present embodiment, "0" is provided as the displacement factor ΔNeVB for the battery voltage VB larger than 13 V. After the displacement factor ΔNeVB has been derived, the program proceeds to Step S312 where the derived displacement factor ΔNeVB is compared wit the target speed feedforward displacement ΔNe set in the previous step (larger one out of the displacement factors ΔNeTW and ΔNeACON). In case of ΔNe ≧ΔNeVB, the program jumps Step S314. In case of Δ−Ne<ΔNeVB, the displacement factor ΔNeVB replaces as the target speed feedforward displacement ΔNe (ΔNe←ΔNeVB). Then, the program proceeds to Step S314.

In Step S314, it is determined whether the target speed feedforward displacement ΔNe thus obtained is "0", that is, whether all the displacement factors ΔNeTW, ΔNeACON and ΔNeVB are "0" since the coolant temperature TW is 80° C. or more, the air conditioner switch 45 is in the OFF state, and the battery voltage VB is 13 V or more. In case of ΔNe≠0 the program jumps to return leaving the target speed feedforward displacement ΔNe as it is.

In case of ΔNe=0 to the contrary, the program proceeds from Step S314 to Step S315 where the displacement factor ΔNeD according to the state of the shift switch 46 (in case of the MT vehicle, a neutral switch). That is, in Step S315, it is determined whether the shift position of the transmission is N range (including P range). In case of N range, the program proceeds to Step S316 where the displacement factor ΔNeD is decreased by a set value MS (Δ NeD←ΔNeD−MS). In Step S317, determination is made whether the displacement factor ΔNeD reaches a lower limit value (for example, −100 rpm). In the case where the displacement factor ΔNeD is equal to or more than the lower limit (ΔNeD≧−100 rpm), the program jumps to Step S321. In the case where the displacement factor ΔNeD crosses the lower limit value (ΔNeD<−100 rpm), the displacement factor ΔNeD is fixed to the lower limit value in Step S318, then proceeding to Step S32.

Accordingly, when the shift position of the transmission is changed from D range (including 1st, 2nd and R ranges) to N range, the displacement factor ΔNeD is gradually decreased by the set value MS until it reaches the lower limit value (−100 rpm), thereby to stabilize the control property.

In the case where it is determined in Step S315 that the shift position of the transmission is D range, the program proceeds to Step S319 where it is determined whether the displacement factor ΔNeD reaches "0". When reaching "0" (ΔNeD≧0), the program jumps to Step S321. When not reaching "0" (ΔNeD<0), the displacement factor ΔNeD is increased by the set value NS (ΔNeD←ΔNeD+NS), then proceeding to Step S321.

That is, when the engine suffers a load for driving the transmission by changing the shift position of the transmission from N range to D range, the displacement factor ΔNeD is gradually increased by the set value NS until reaching "0" whereby the control property is improved.

In Step S321, the displacement factor ΔNeD thus calculated is set as the target speed feedforward displacement ΔNe (ΔNe←ΔNED), then the program returns.

Figure 7:
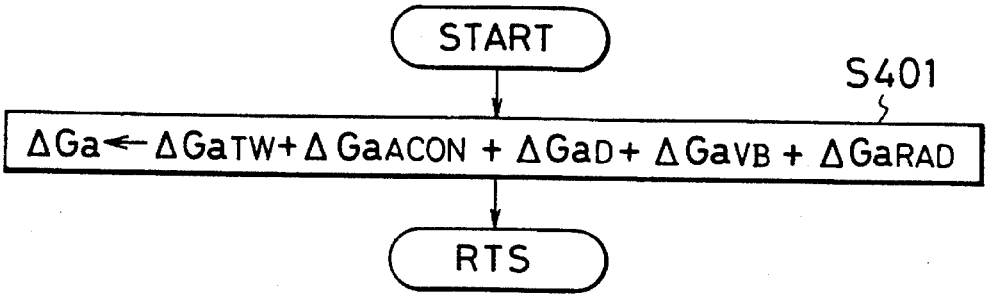
FIG. 7 is a flowchart of a subroutine for calculating a feedforward amount to displace the target physical amount depending on the load change

In the intake air feedforward displacement calculating sub-routine shown in FIG. 7, in Step S401, a displacement factor ΔGaTW (map value) based on the coolant temperature TW, a displacement factor ΔGaACON in response to turning the air conditioner switch 45 ON, a displacement factor Δ GaD in response to the state of the shift switch 46 of the au transmission (1st, 2nd, D ranges), a displacement factor ΔGaVB (map value) based on the battery voltage VB, and a displacement factor ΔGaRA in response to turning the radiator fan switch 43 ON are totaled to provide the intake air feedforward displacement ΔGa (ΔGa←ΔGaTW+ΔGaACON+ ΔGaD+ΔGaVB+ΔGaRAD).

Figure 8:
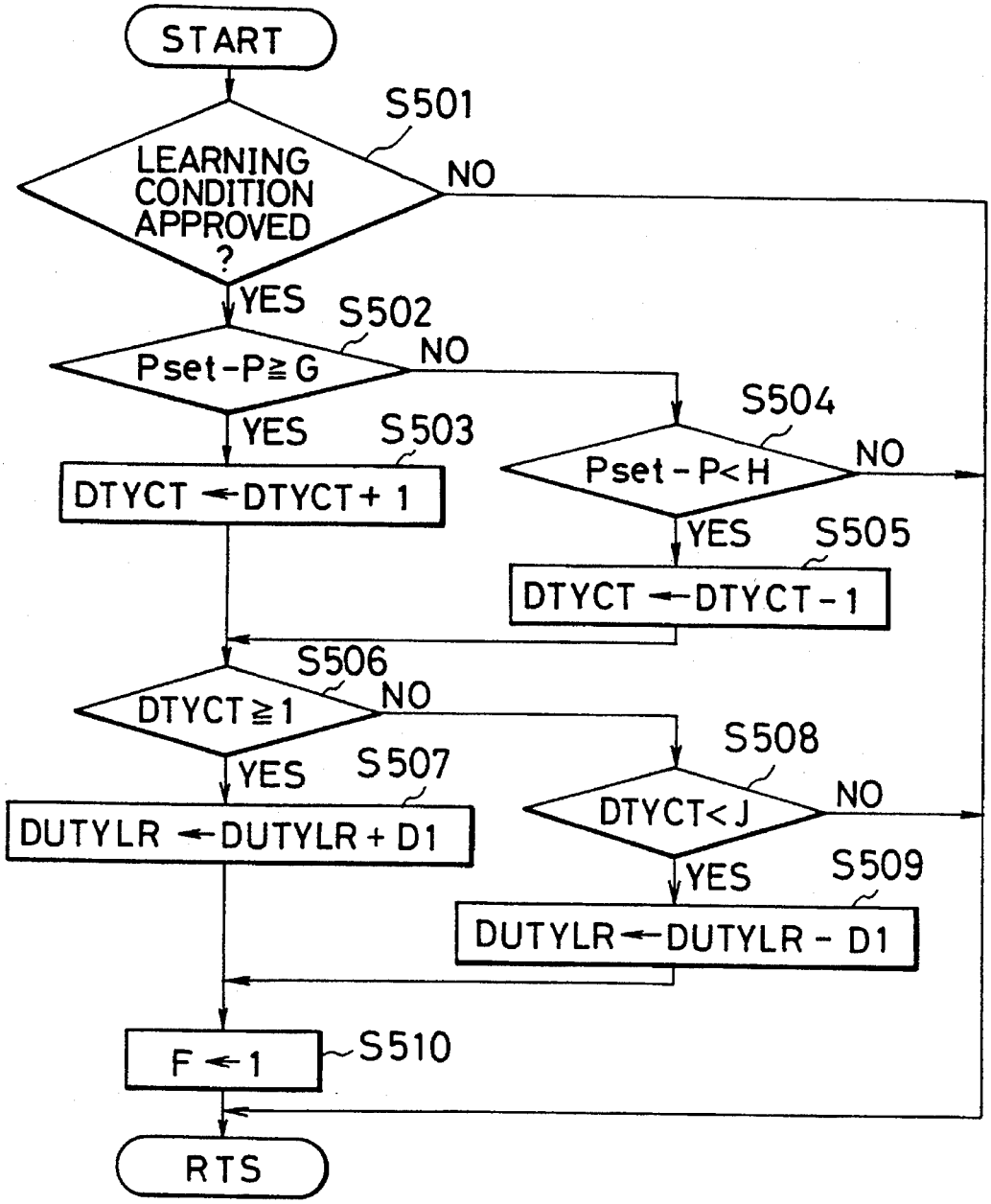
FIG. 8 is a flowchart of a learning value calculating subroutine.

Furthermore, FIG. 8 shows the learning value calculating subroutine executed every 250 ms. In Step S501, it is determined whether all the following learning conditions (1) to (6) are fulfilled to perform the learning.

(1) The engine is not in the stop state.

(2) The shift position of the automatic transmission is N range or P range.

(3) A predetermined time has elapsed after the idling switch **33*b*** has bee n turned OFF.

(4) The intake air feedforward displacement ΔGa=0.

(5) The engine speed Ne is within an allowable range (NSETI≧Ne≧NSET2) preset with respect, to the target engine speed NSET.

(6) Not already learned (the learning flag F is not set).

In the case where even one condition not fulfilled is present, the program jumps to return. In the case where it is so determined in Step S501 that all the conditions are fulfilled to enable learning, the program proceeds to Step S502 where a difference (Pset−P) between the target intake air pressure Pset and the actual intake air pressure P is compared with a set value G (plus value) which is an upper limit of an allowable range thereof. In case of (Pset−P) =G, it is determined that there is a possibility of the deterioration of the ISCV 16 due to a carbon or the like adhered to the ISCV 16, and then the program proceeds to Step S503 to count up a counter DTYCT (DTYCT←DTYCT +1).

Moreover, in case of (Pset–P)<G in Step S502, the program is branched from Step S502 to Step S504 where such the difference (Pset–P) is then compared with a set value H (minus value) which is a lower limit of the allowable range thereof. In case of (Pset–P)<H, it is determined that such the difference (Pset–P) is within the allowable range, and then the program jumps so as to hold the present learning value DUTYLR. In case of (Pset–P)< H, it is determined that there is a possibility that the ISCV 16 is a mechanically inferior goods, and then in succeeding Step S505 the counter DTYCT is counted down (DTYCT←DTYCT–1).

Step S506 follows Step S503 or Step S505. In Step S505, the counter DYTCT is compared with a set number I (plus value). When DYTCT≧I, that is, the number of times in which the difference (Pset–P) exceeds the upper limit of the allowable range, exceeds the set number I, it is determined that the ISCV 16 actually deteriorates due to the accumulation of carbons or the like. And then, in Step S507, the present learning value DUTYLR stored in the backup RAM 61 is increased by a set value D1 (DUTYLR←DUTYLR+D1) in order to make correction in a direction of enlarging the duty ratio DUTYisc. In Step S510, the learning flag F for indicating that renewing of the learning value DUTYLR was made is set (F←1), then the program returns.

In case of DTYCT<I to the contrary in Step S506, the program is branched to Step S508 to compare the counter DTYCT with a set number J (minus value). In case of DYTCT≧J, the program jumps so as to hold the present learning value DUTYLR. When DTYCT<J, that is, the number of times in which the difference (Pset–P) exceeds the lower limit of the allowable range, exceeds the set number J, it is determined that actually the ISCV 16 is a mechanically inferior goods. Then, the present learning value DUTYLR is decreased by the set value D1 (DUTYLR←DUTYLR–D1) in order to make correction in a direction of reducing the duty ratio DUTYisc. The program returns through Step S510.

The counter DTYCT and the learning flag F are initially set to "0" when the system is initialized. As previously mentioned, since the learning flag F is referred to in the beginning of the learning value calculating sub-routine (note the learning condition (6)), the renewing of the learning value DUTYLAR is made only once during the operation time of the engine from turning the ignition switch 56 ON to OFF.

Figure 9:
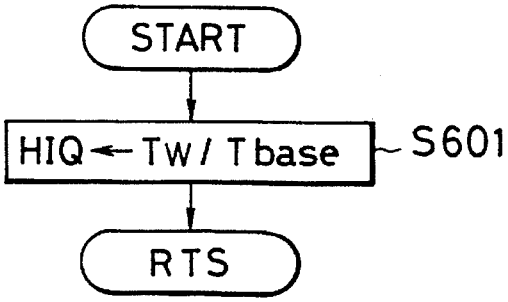
FIG. 9 is a flowchart of a coolant temperature correction value calculating subroutine.

In the coolant temperature correction value calculating subroutine shown in FIG. 9, in Step S601, the coolant temperature TW detected by the coolant temperature sensor 36 every predetermined timing is divided by the basic temperature Tbase to calculate the coolant temperature correction value HIQ (HIQ←TW/Tbase), and then the program returns.

Figure 10:
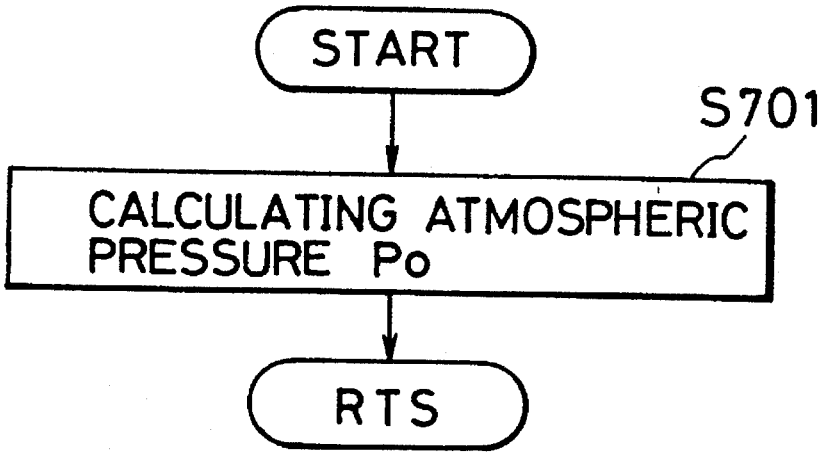
FIG. 10 is a flowchart of an atmospheric pressure calculating subroutine.

Further, in the atmospheric pressure calculating subroutine shown in FIG. 10, in Step S701 the atmospheric pressure PO is calculated on the basis of the signal from the atmospheric pressure sensor 44, and then the program returns.

Figure 11:
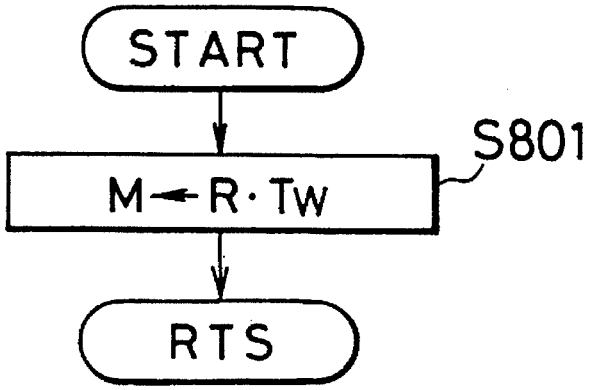
FIG. 11 is a flowchart of a temperature function calculating subroutine.

In the temperature function calculating sub-routine shown in FIG. 11, in Step S801 the gas constant R is multiplied by the coolant temperature TW from the coolant temperature sensor 36 to calculate the temperature function M (M←R×TW), and then the program returns.

Based on the various parameters thus calculated, the target intake air amount per intake stroke is calculated in the basic routine, and then the duty ratio DUTYisc for the ISCV 16 is provided in the basic routine and the fuel injection amount is calculated in the fuel injection amount calculating subroutine.

In the basic routine, in Step S101, known fixed values such as the constants K2 and K3 and the cylinder volume Vcy are read from the ROM 59. And the temperature function M calculated in the temperature function calculating sub-routine shown in FIG. 11 and the actual intake air pressure P measured by the intake air pressure sensor 22 are also read from the RAM 60. These read values are used to calculate the actual intake air amount Ga per intake stroke using the aforementioned Equation (3) (Ga←(K3×Vcy/M)×P–K2).

Figure 4:
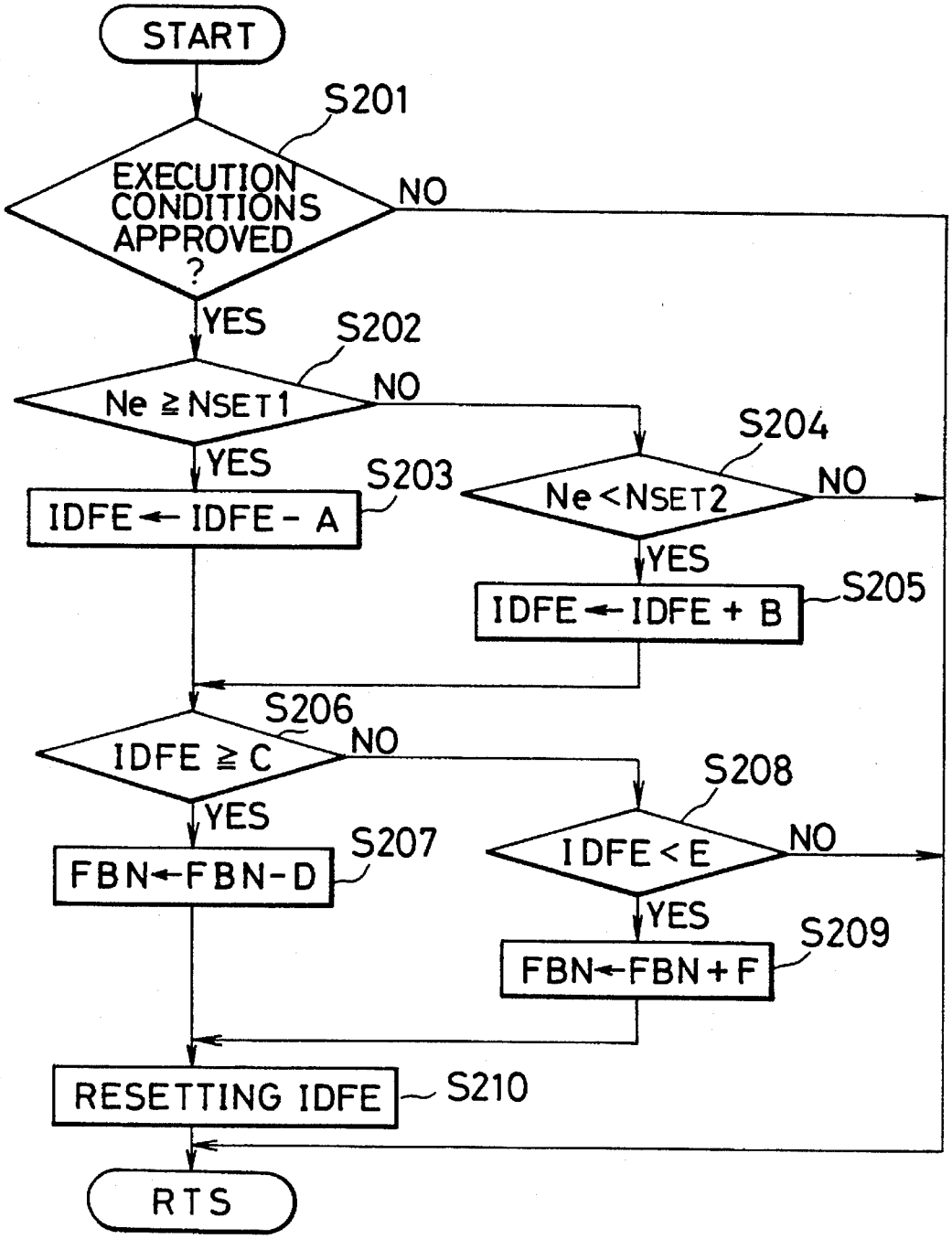
FIG. 4 is a flowchart of a subroutine for calculating an integration amount applied to a target physical amount.
Figure 5:
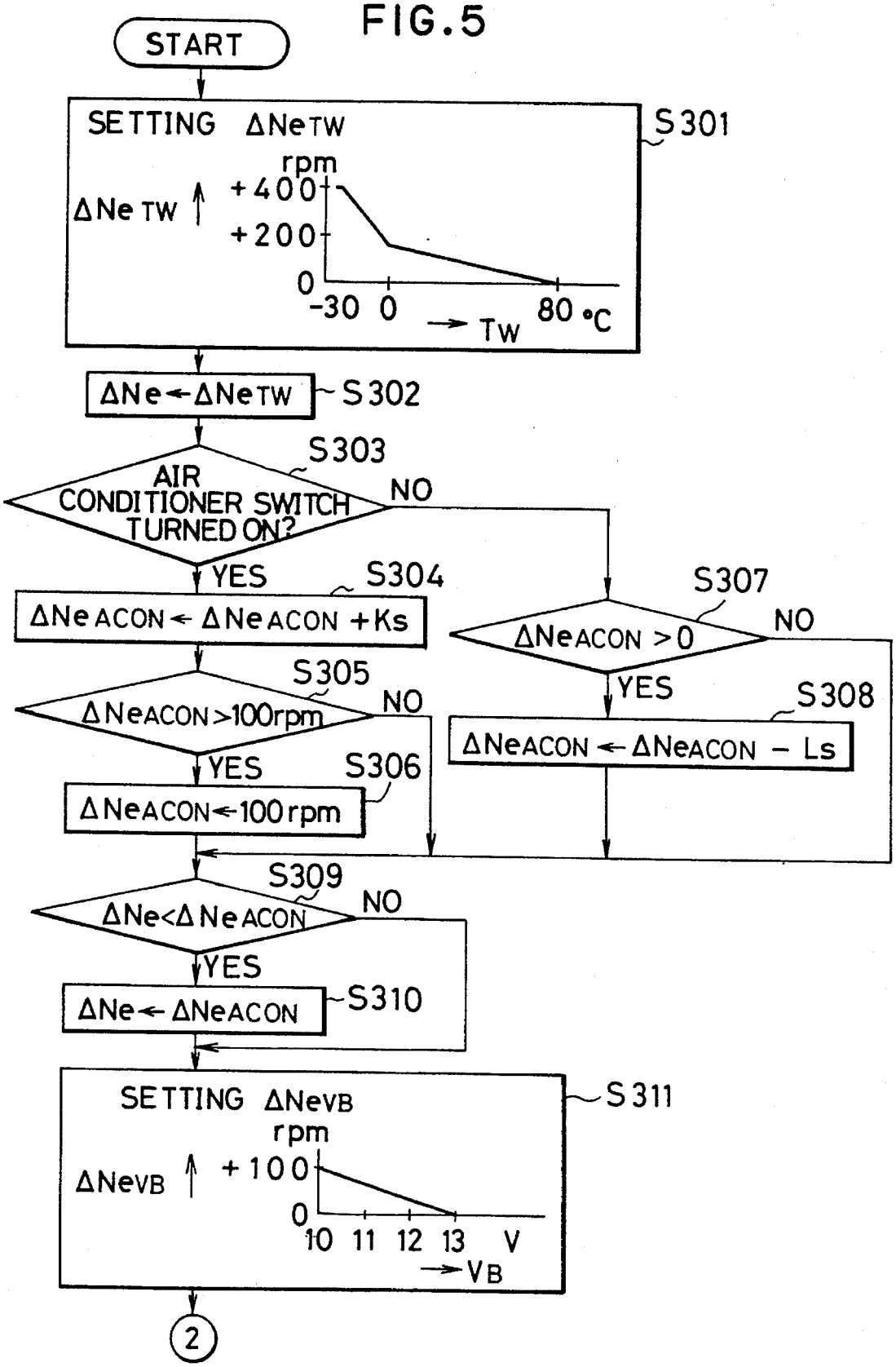
FIGS. 5 and 6 are respectively flowcharts of a subroutine for calculating a feedforward amount to displace a target idling speed.
Figure 6:
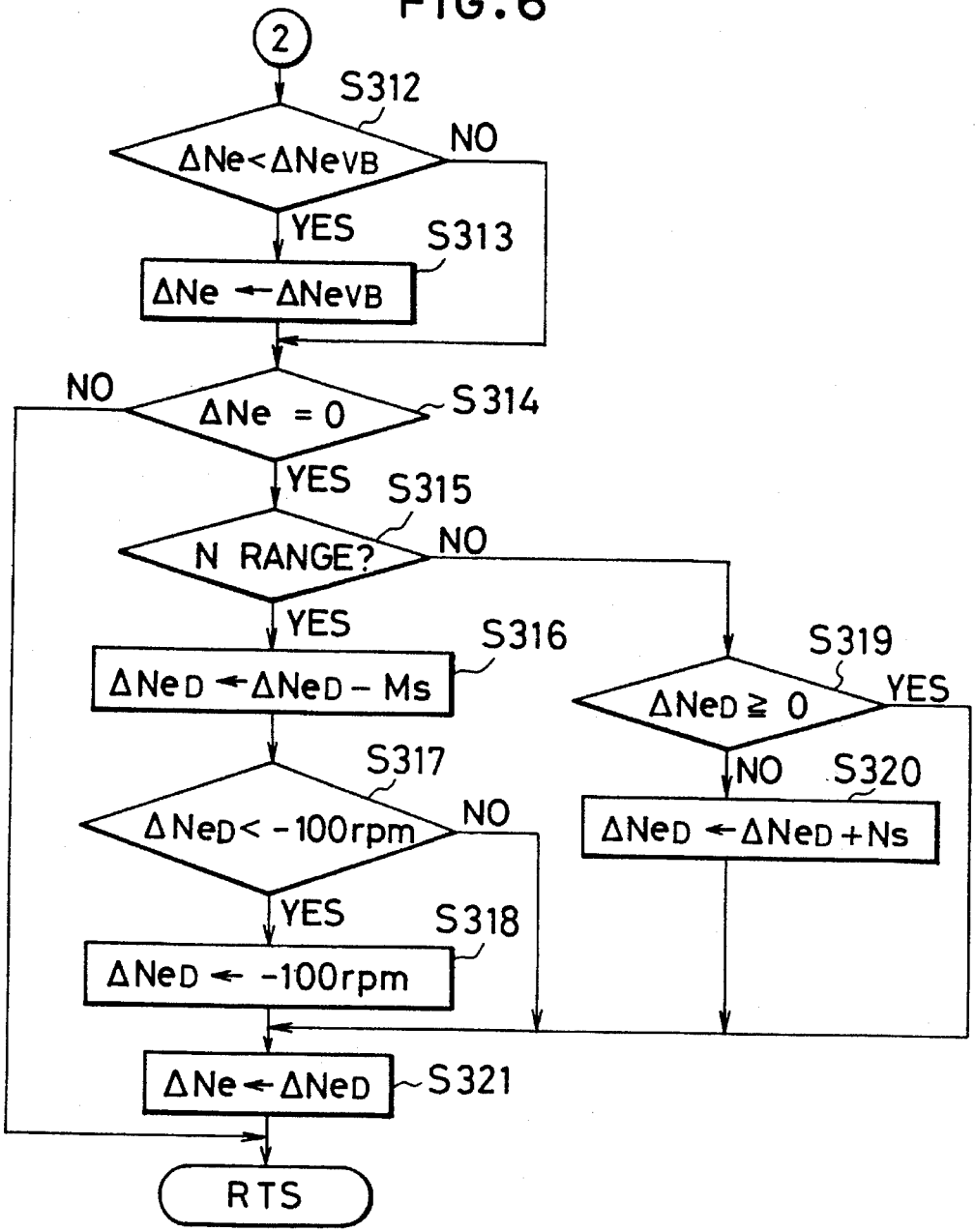

Next, in Step S102, to calculate the map reference parameter IRPM, the integration amount FBN calculated in the integration amount calculating sub-routine shown in FIG. 4 is added to the actual engine speed Ne calculated on the basis of the signals from the crank angle sensor 39, and the target speed feedforward displacement ΔNe calculated in the sub-routine shown in FIGS. 5 and 6 is subtracted therefrom (IRPM←Ne+FBN–ΔNe).

In succeeding Step S103, the map reference parameter IRPM is used as a parameter to derive the basic intake air amount Gabase per intake stroke from the Ga-Ne map. Then, the program proceeds to Step S104 where the intake air feedforward displacement ΔGa calculated in the sub-routine shown in FIG. 7 is added to the basic intake air amount Gabase per intake stroke to produce the target intake air amount Gaset per intake stroke (Gaset ←Gabase+ΔGa). The program proceeds to Step S105.

In Step S105, the target intake air pressure Pset is calculated by the above-described Equation (8) using the target intake air amount Gaset per intake stroke and the fixed values K2, K3 and Vcy read from the ROM 59 (Pset ←Gaset+K2×M/(K3×Vcy)).

In the succeeding Step S106, the map reference parameter IRPM is compared with the cranking speed Nst to determine whether the control at extremely low engine speed such as the cranking of the engine should be carried out. In case of IRPM≦Nst, the program proceeds to S107 to set the actual intake air amount Ga per intake stroke calculated in Step S101 as the target intake air amount Gaset per intake stroke (Gaset←Ga) for the control at extremely low engine speed. Then, the program proceeds to Step S108. In case of IRPM>Nst to the contrary in Step S106, the program proceeds to Step S108, maintaining the target intake air amount Gaset per intake stroke calculated in Step S104 to perform the usual idling speed control.

Figure 3:
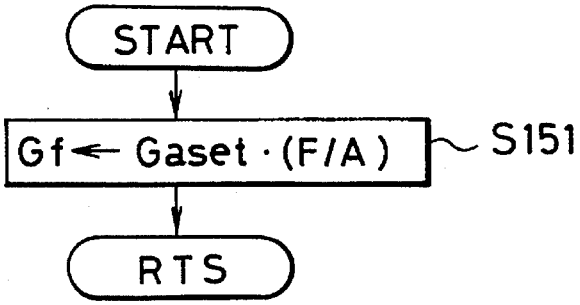
FIG. 3 is a flowchart of a fuel injection amount calculating subroutine.

The target intake air amount Gaset per intake stroke thus calculated is stored in the RAM 60, which is in turn referred to the fuel injection amount calculating sub-routine shown in FIG. 3. In the fuel injection amount calculating sub-routine, the target intake air amount Gaset per intake stroke is multiplied by the target fuel air ratio F/A to calculate the fuel injection amount Gf (Gf←Gaset×(F/A)) in step S151, and then the program returns.

Back to the basic routine, when the program proceeds to Step S108 from Step S106 or Step S107, the amount Qcy of air to be induced into the cylinder is calculated with the above-described Equation (7) (Qcy←N×Ga ×Ne/2), then proceeding to S109.

In Step S109, the amount Qisc of air passing through the ISCV 16 is calculated with the above-described Equation (6) (Qisc=(Pset–P)×V/(Δt× M)+Qcy), using the target intake air pressure Pet calculated in step S105, the amount Qcy of air to be induced into the cylinder calculated in Step S108, the temperature function M calculated in the sub-routine shown in FIG. 11, the chamber volume V stored in the ROM 59, and the actual intake air pressure P measured by the intake air pressure sensor 22.

Next, the program proceeds to Step S110, where the amount Qisc of air passing through the ISCV 16 calculated in Step S109 is corrected by the coolant temperature correction value HIQ calculated in the sub-routine shown in FIG. 9 to produce the corrected amount Qisc'(Qisc'←Qisc× HIQ). Then, in Step S111, the Qisc' and the pressure differential Pi before and after the ISCV 16 are used as parameters to derive the basic duty ratio DUTY from the duty ratio map.

After deriving the basic duty ratio DUTY in Step S111, the program proceeds to Step S112, where the learning value DUTYLR calculated in the sub-routine shown in FIG. 8 is added to the basic duty ratio DUTY to provide the final duty ratio DUTYisc to be output to the ISCV 16 in Step S113, and then the program returns.

Figure 1:
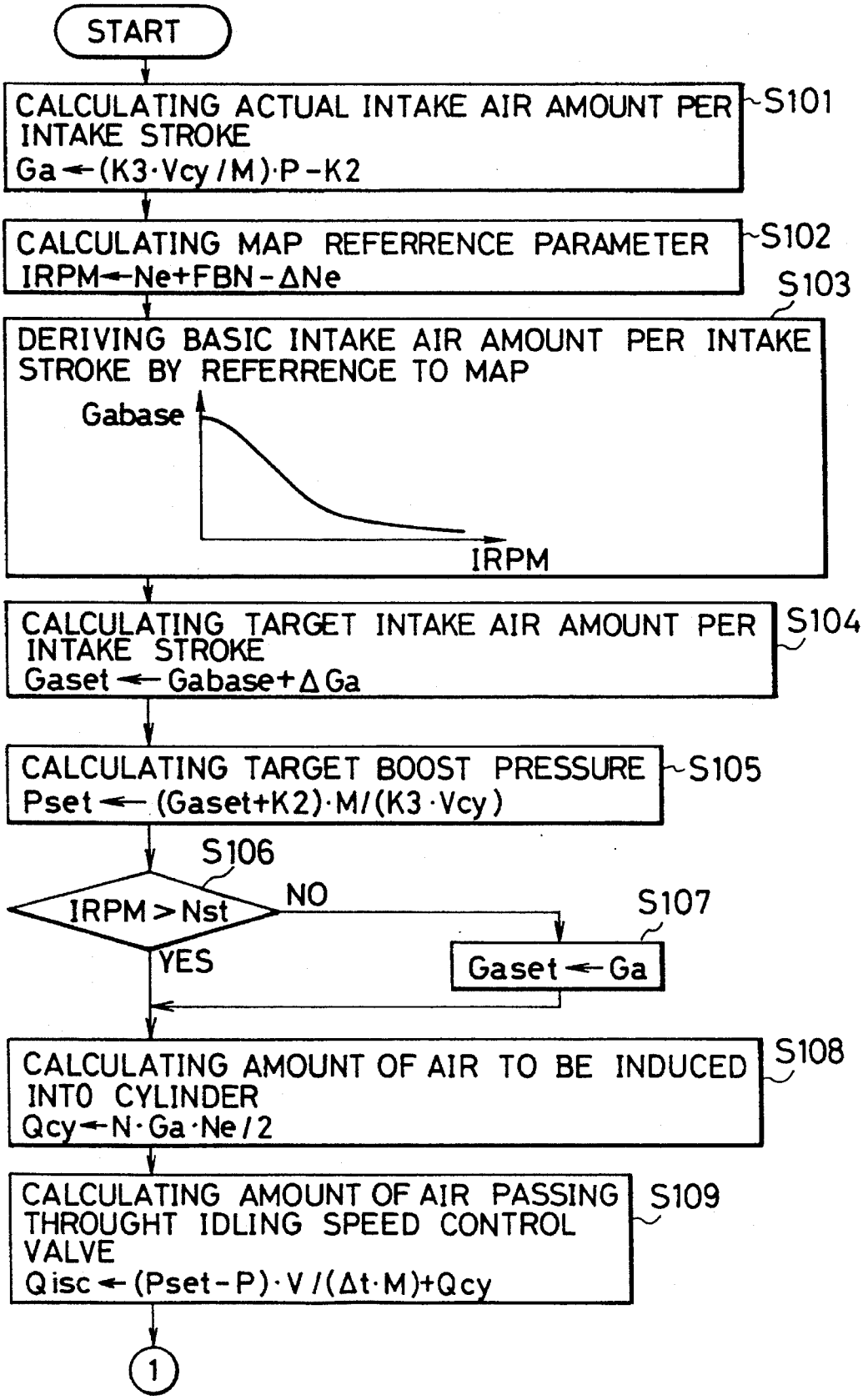
FIGS. 1 and 2 are respectively flowcharts of an idling speed control basic routine of the present invention.
Figure 35:
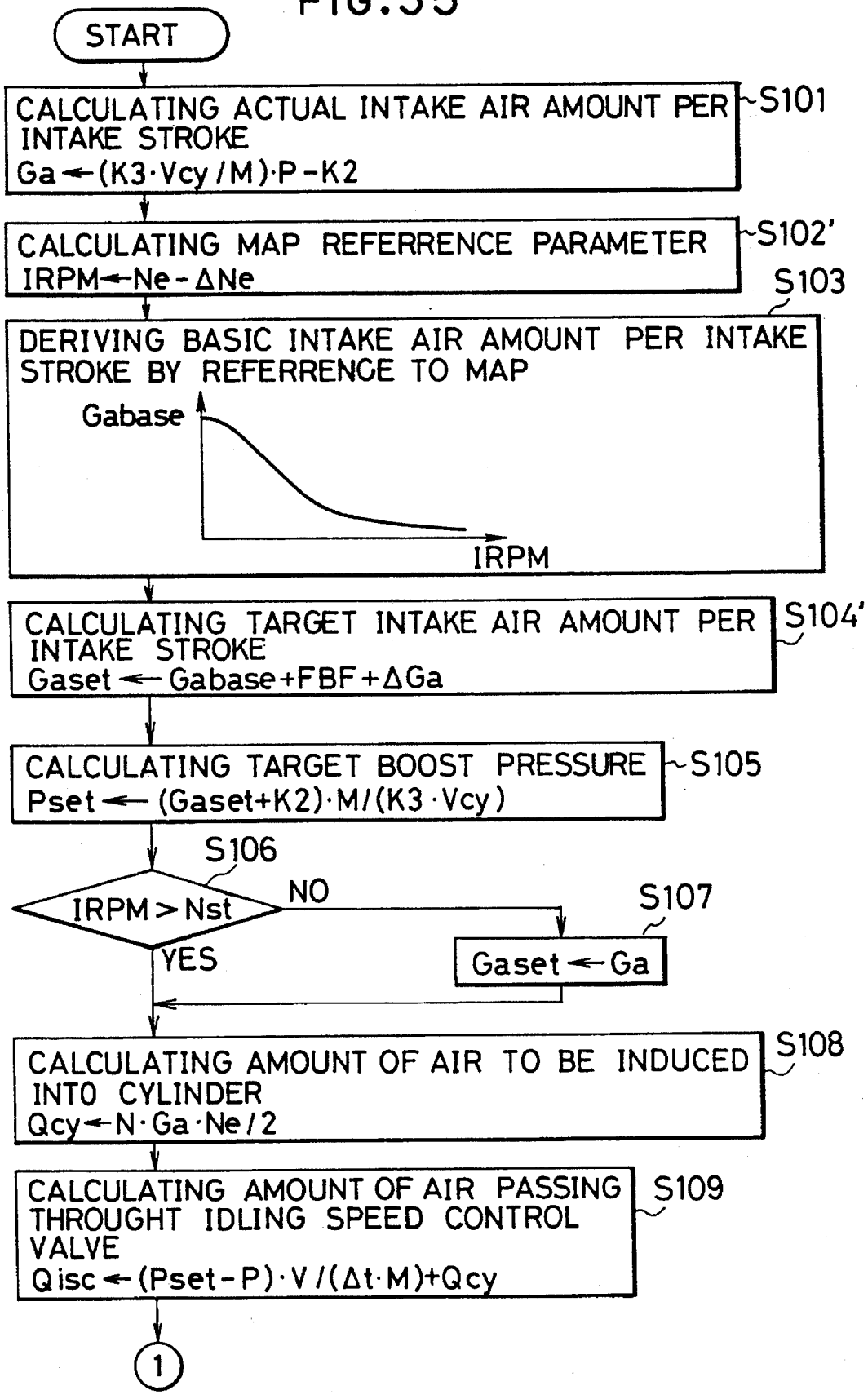
FIG. 35 is a flowchart of a subroutine for calculating an integration amount according to the second embodiment.
Figure 36:
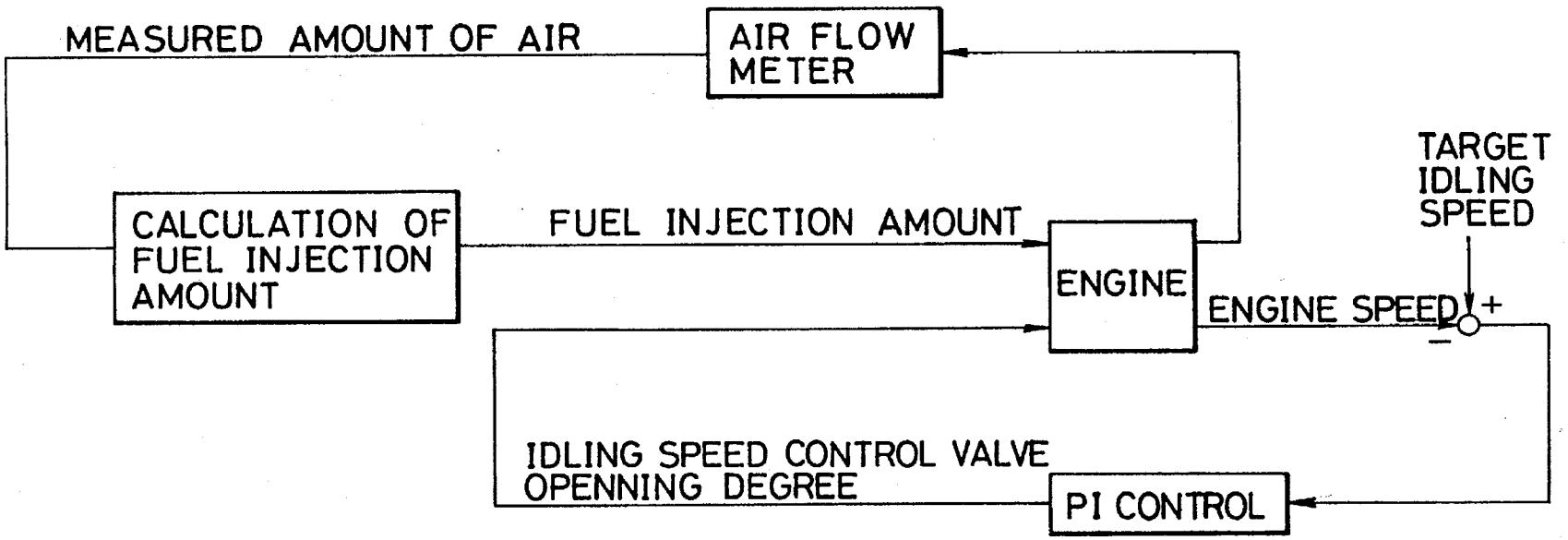
FIG. 36 is a block diagram of the idling speed control according to the conventional system.

FIG. 35 is a flowchart which can be adopted instead of the flowchart shown in FIG. 1. The flowchart shown in FIG. 35 contains the I control in which the Ga-Ne map is displaced along the Ga axis, whereas it is displaced along the Ne axis in the flowchart shown in FIG. 1. Except this change, the logic of both flowcharts is basically same.

An integration amount FBF is calculated similarly to the integration amount FBN described in FIG. 1. Therefore, in the flowchart shown in FIG. 4, FBN may be read as FBF, and the set values A, B, C, D, E and F may be read as set values A', B', C', D', E' and F', respectively.

With respect to the flowchart shown in FIG. 35, the different steps will be described.

In Step S102, the map reference parameter IRPM, which is a reference parameter of the basic intake air amount per intake stroke, is obtained by subtracting the target speed feedforward displacement ΔNe from the actual engine speed Ne (IRPM←Ne−ΔNe). In Step S104', the integration amount FBF and the intake air feedforward displacement ΔGa are added to the basic intake air amount Gabase per intake stroke derived from the Ga-Ne map according to the map reference parameter IRPM to obtain the target intake air amount Gaset per intake stroke (Gaset←Gabase+FBF+ΔGa).

Figure 2:
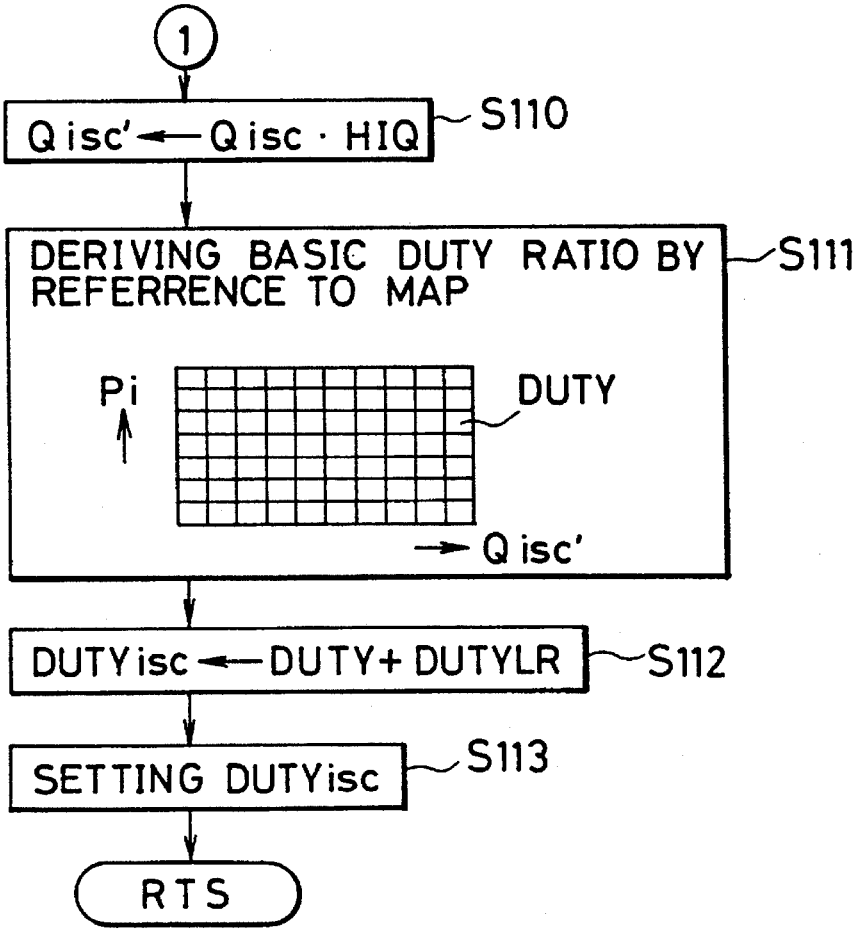

Therefore, in the sub-routine shown in FIG. 3, the fuel injection amount Gf is calculated on the basis of the target intake air amount Gaset per intake stroke, and in Step S108 and thereafter in FIGS. 35 and 2, the duty ratio DUTYisc to be output to the ISCV 16 is calculated.

As described above, according to the present invention, there can be obtained the excellent idling speed control in which its responsibility to load changes and convergence to a target idling speed are improved since a fuel injection amount and an intake air amount flowing into the cylinder are simultaneously adjusted by using a target physical amount regarded to be a linear relation with an indicated torque of the engine as a controlled amount.

What is claimed is:

1. A system for controlling an idling speed of an engine having a cylinder, an injector for injecting fuel to be supplied to said cylinder, an intake passage, a throttle valve installed in said intake passage, a bypass passage bypassing said throttle valve and an idling speed control valve installed in said bypass passage for adjusting an amount of air flowing into said cylinder during an idling state of said engine, the system comprising:

engine speed detecting means for detecting an actual engine speed;

integration amount calculating means for calculating an integration amount based on an error between the actual engine speed and a predetermined target idling speed;

reference parameter calculating means for calculating a reference parameter based on the actual engine speed and the integration amount;

target physical amount providing means for providing an appropriate target physical amount which takes a balance between the engine torque and the engine friction around the predetermined target idling speed, depending on the reference parameter;

fuel injection amount calculating means for calculating a fuel injection amount in accordance with the target physical amount, the fuel injection amount being injected by the injector; and opening degree determining means for determining an opening degree of the idling speed control valve in accordance with the target physical amount, the idling speed control valve being opened by the determined opening degree.

2. The system according to claim 1, further comprising:

target speed feedforward displacement calculating means for calculating a target speed feedforward displacement in accordance with engine operating conditions, the target speed feedforward displacement being used to calculate reference parameter.

3. The system according to claim 1, further comprising:

target speed feedforward displacement calculating means for calculating a target speed feedforward displacement in accordance with at least one of coolant temperature, air conditioner switch position, battery voltage and shift switch position, the target speed feedforward displacement being used to calculate reference parameter.

4. The system according to claim 1, further comprising:

intake air feedforward displacement calculating means for calculating an intake air feedforward displacement in accordance with engine operating conditions; and correcting means for correcting the target physical amount by the intake air feedforward displacement.

5. The system according to claim 1, further comprising:

intake air feedforward displacement calculating means for calculating an intake air feedforward displacement in accordance with at least one of coolant temperature, air conditioner switch position, shift switch position, battery voltage and radiator fan switch position; and correcting means for correcting the target physical amount by the intake air feedforward displacement.

6. The system according to claim 1, further comprising:

intake air pressure detecting means for detecting an actual intake air pressure; and learning means for calculating a learning value for the idling speed control valve in accordance with a difference between the actual intake air pressure and a predetermined target intake air pressure, the opening degree of the idling speed control valve being corrected by the learning value.

7. The system according to claim 1, further comprising:

intake air pressure detecting means for detecting an actual intake air pressure;

actual intake air amount calculating means for calculating an actual intake air amount per engine cycle based on the detected actual intake air pressure;

engine cranking state determining means for determining whether the engine is in a cranking state; and cranking control means for setting the actual intake air amount per intake stroke as the target physical amount when it is determined that the engine is in the cranking state, whereby both of the fuel injection amount and the opening degree of the idling speed control valve are determined, during the engine cranking state, based on the actual intake air amount per intake stroke in place of the target physical amount.

8. The system according to claim 1, wherein the target physical amount is a target intake air amount per engine cycle having a linear relationship with the engine torque.

9. A system for controlling an idling speed of an engine having a cylinder, an injector for injecting fuel to be supplied to said cylinder, an intake passage, a throttle valve installed in said intake passage, a bypass passage bypassing said throttle valve and an idling speed control valve installed in said bypass passage for adjusting an amount of air flowing into said cylinder during an idling state of said engine, the system comprising:

engine speed detecting means for detecting an actual engine speed;

target speed feedforward displacement calculating means for calculating a target speed feedforward displacement in accordance with engine operating conditions;

reference parameter calculating means for calculating a reference parameter based on the actual engine speed and the target speed feedforward displacement;

target physical amount providing means for providing a target physical amount which takes a balance between the engine torque and the engine friction around the predetermined target idling speed, depending on the reference parameter;

fuel injection amount calculating means for calculating a fuel injection amount in accordance with the target physical amount, the fuel injection amount being injected by the injector; and opening degree determining means for determining an opening degree of the idling speed control valve in accordance with the target physical amount, the idling speed control valve being opened by the determined opening degree.

10. The system according to claim 9, further comprising:

integration amount calculating means for calculating an integration amount based on an error between the actual engine speed and a predetermined target idling speed, the target physical amount being corrected by the integration amount.

11. The system according to claim 9, further comprising:

intake air pressure detecting means for detecting an actual intake air pressure; and learning means for calculating a learning value for the idling speed control valve in accordance with a difference between the actual intake air pressure and a predetermined target intake air pressure, the opening degree of the idling speed control valve being corrected by the learning value.

12. The system according to claim 9, further comprising:

intake air pressure detecting means for detecting an actual intake air pressure;

actual intake air amount calculating means for calculating an actual intake air amount per engine cycle based on the detected actual intake air pressure;

engine cranking state determining means for determining whether the engine is in a cranking state; and cranking control means for setting the actual intake air amount per intake stroke as the target physical amount when it is determined that the engine is in the cranking state, whereby both of the fuel injection amount and the opening degree of the idling speed control valve are determined, during the engine cranking state, based on the actual intake air amount per intake stroke in place of the target physical amount.

13. The system according to claim 9, wherein the target physical amount is a target intake air amount per engine cycle having a linear relationship with the engine torque.

* * * * *